US011331941B2

(12) United States Patent
Busam et al.

(10) Patent No.: US 11,331,941 B2
(45) Date of Patent: May 17, 2022

(54) EDGE TABS FOR NOTEBOOK

(71) Applicant: ACCO Brands Corporation, Lake Zurich, IL (US)

(72) Inventors: Edward P. Busam, Mason, OH (US); Kenneth P. Richied, Cincinnati, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 17/236,579

(22) Filed: Apr. 21, 2021

(65) Prior Publication Data

US 2021/0252899 A1 Aug. 19, 2021

Related U.S. Application Data

(63) Continuation of application No. 16/788,441, filed on Feb. 12, 2020, now Pat. No. 11,027,569, which is a continuation of application No. 13/265,886, filed as application No. PCT/US2011/038294 on May 27, 2011, now Pat. No. 10,596,845.

(60) Provisional application No. 61/349,549, filed on May 28, 2010.

(51) Int. Cl.

| | |
|---|---|
| ***B42D 13/00*** | (2006.01) |
| ***B42B 5/12*** | (2006.01) |
| ***B42D 1/00*** | (2006.01) |
| ***B42D 1/06*** | (2006.01) |
| ***B42D 3/12*** | (2006.01) |
| ***B42F 21/12*** | (2006.01) |

(52) U.S. Cl.

CPC ..... *B42D 13/00* (2013.01); *B42B 5/12* (2013.01); *B42D 1/004* (2013.01); *B42D 1/06* (2013.01); *B42D 3/12* (2013.01); *B42F 21/12* (2013.01)

(58) Field of Classification Search

CPC . B42D 13/00; B42D 1/06; B42D 3/12; B42D 1/004; B42D 1/00; B42F 21/12; B42B 5/12

USPC ..... 283/36, 37, 38, 39, 41, 43; 402/79

See application file for complete search history.

(56) References Cited

U.S. PATENT DOCUMENTS

| | | | |
|---|---|---|---|
| 1,048,577 | A | 12/1912 | Pardoe, Jr. |
| 1,481,402 | A | 1/1924 | Wetzel et al. |
| 1,552,103 | A | 9/1925 | Wood |
| 1,607,063 | A | 11/1926 | Dunn |

(Continued)

FOREIGN PATENT DOCUMENTS

| | | |
|---|---|---|
| EP | 1346848 | 9/2003 |
| JP | H07149090 | 6/1995 |

(Continued)

OTHER PUBLICATIONS

"Blank Index Tab Dividers," by Permaseal Corporation, Managing Office Technology, 39, 9; ABI/INFORM Global, p. 85 (Sep. 1994).

(Continued)

*Primary Examiner* — Justin V Lewis

(74) *Attorney, Agent, or Firm* — Fitch, Even, Tabin & Flannery LLP

(57) ABSTRACT

A tab is provided for notebooks and binders. The tab is placed within the space otherwise occupied by a binding, and thus is protected from wear and does not appreciably increase the overall size of the notebook or binder. The tab may be located at a corner of the binding or at an intermediate point along the binding.

19 Claims, 25 Drawing Sheets

(56) References Cited

U.S. PATENT DOCUMENTS

| | | | | |
|---|---|---|---|---|
| 1,682,192 | A | | 8/1928 | Schoolburg |
| 1,761,078 | A | | 6/1930 | Kalada |
| 1,843,771 | A | | 2/1932 | Kline |
| 1,876,181 | A | | 9/1932 | Tussing |
| 2,001,462 | A | | 5/1935 | Hiller |
| 2,300,623 | A | | 11/1942 | Hornung |
| 2,599,768 | A | | 6/1952 | Losch, Jr. |
| 3,014,580 | A | | 12/1961 | Brody et al. |
| 3,561,147 | A | | 2/1971 | Valencia |
| 3,566,522 | A | | 3/1971 | Leach |
| 3,700,264 | A | | 10/1972 | Friedman |
| 3,877,729 | A | | 4/1975 | Friedman |
| 3,913,740 | A | | 10/1975 | Bisberg |
| RE29,422 | E | | 10/1977 | Cunningham |
| 4,079,533 | A | | 3/1978 | Rohner |
| 4,193,704 | A | | 3/1980 | Miller et al. |
| 4,314,635 | A | | 2/1982 | Fraser et al. |
| 4,384,417 | A | | 5/1983 | Thompson |
| 4,395,059 | A | | 7/1983 | Russell, III |
| 4,400,107 | A | | 8/1983 | Pitts |
| 4,430,015 | A | | 2/1984 | Nerlinger |
| 4,498,828 | A | | 2/1985 | Ackerman |
| 4,516,871 | A | | 5/1985 | Leitman |
| 4,595,309 | A | | 6/1986 | Chinchar |
| 4,660,855 | A | | 4/1987 | Pagliaccio |
| 4,758,022 | A | | 7/1988 | Podosek et al. |
| 4,840,406 | A | | 6/1989 | Pitts |
| 4,863,194 | A | | 9/1989 | Friedman |
| 4,877,269 | A | | 10/1989 | Callaghan |
| 4,905,388 | A | | 3/1990 | Sinkow |
| 4,948,173 | A | | 8/1990 | Hincks et al. |
| 4,961,666 | A | | 10/1990 | Pitts et al. |
| 5,033,899 | A | | 7/1991 | Pitts et al. |
| 5,125,561 | A | | 6/1992 | Idstein |
| 5,127,674 | A | | 7/1992 | Lamphere et al. |
| 5,186,565 | A | | 2/1993 | Jack |
| D337,784 | S | | 7/1993 | Wyant |
| 5,240,340 | A | | 8/1993 | Lynch et al. |
| 5,275,439 | A | | 1/1994 | Hawes |
| 5,350,061 | A | | 9/1994 | Gunn |
| 5,388,861 | A | | 2/1995 | Reiter |
| 5,407,231 | A | | 4/1995 | Schwartz |
| 5,540,513 | A | | 7/1996 | Wyant |
| 5,590,911 | A | | 1/1997 | Wilson |
| 5,599,128 | A | | 2/1997 | Steiner |
| 5,639,124 | A | | 6/1997 | Jung |
| 5,683,113 | A | | 11/1997 | Petrucci |
| 5,683,194 | A | | 11/1997 | Emmel et al. |
| 5,785,446 | A | | 7/1998 | Dlugos |
| 5,836,711 | A | | 11/1998 | Stewart |
| 5,853,259 | A | * | 12/1998 | Murray, Jr. ..... B42F 13/006 402/3 |
| 5,876,145 | A | | 3/1999 | Datum |
| 5,918,314 | A | | 7/1999 | Moses |
| 5,954,445 | A | | 9/1999 | Deutschmann et al. |
| 6,017,062 | A | | 1/2000 | White |
| 6,209,778 | B1 | | 4/2001 | Henrikson et al. |
| D451,273 | S | | 12/2001 | Moor et al. |
| 6,390,713 | B1 | | 5/2002 | Moor et al. |
| 6,409,409 | B2 | | 6/2002 | Bauman et al. |
| D462,715 | S | | 9/2002 | Moor et al. |
| 6,505,859 | B1 | | 1/2003 | Josephson |
| 6,626,601 | B1 | | 9/2003 | Moor et al. |
| 6,672,758 | B2 | | 1/2004 | Ehrsam et al. |
| 6,732,461 | B2 | | 5/2004 | Slattery et al. |
| 6,736,428 | B1 | | 5/2004 | Insalaco |
| 6,758,498 | B2 | | 7/2004 | Sapienza et al. |
| 6,773,195 | B2 | | 8/2004 | Tims |
| 6,776,550 | B2 | | 8/2004 | Roca |
| 7,305,784 | B2 | | 12/2007 | Black |
| 7,628,426 | B1 | | 12/2009 | Rowe et al. |
| 7,819,432 | B2 | | 10/2010 | Rowe et al. |
| 2001/0013698 | A1 | | 8/2001 | Soussan |
| 2001/0022916 | A1 | | 9/2001 | Moor et al. |
| 2002/0101073 | A1 | | 8/2002 | Lang |
| 2004/0040193 | A1 | | 3/2004 | Slattery et al. |
| 2004/0247375 | A1 | | 12/2004 | Wehmeyer et al. |
| 2005/0093290 | A1 | | 5/2005 | Richied |
| 2006/0059755 | A1 | | 3/2006 | Valade et al. |
| 2006/0076771 | A1 | | 4/2006 | Schafer |
| 2006/0131867 | A1 | | 6/2006 | Charmichael et al. |
| 2006/0285914 | A1 | | 12/2006 | Bassford et al. |
| 2007/0029777 | A1 | | 2/2007 | Williams |
| 2008/0016743 | A1 | | 1/2008 | Graves |
| 2008/0085146 | A1 | | 4/2008 | Botkin |
| 2008/0157516 | A1 | | 7/2008 | Gokkel |
| 2008/0231038 | A1 | | 9/2008 | Canasi |
| 2008/0308621 | A1 | | 12/2008 | Spink |
| 2009/0003925 | A1 | | 1/2009 | Chizmar |
| 2009/0311037 | A1 | | 12/2009 | Leung |
| 2010/0119292 | A1 | | 5/2010 | Barausky et al. |
| 2010/0202821 | A1 | | 8/2010 | Regala |

FOREIGN PATENT DOCUMENTS

| | | |
|---|---|---|
| JP | H0971065 | 3/1997 |
| JP | H09295488 | 11/1997 |
| JP | H10297146 | 11/1998 |
| JP | H1178341 | 3/1999 |
| JP | 2001002152 | 1/2001 |
| JP | 2008023901 | 2/2008 |
| WO | 9622888 | 8/1996 |

OTHER PUBLICATIONS

"Bound material tabs," Managing Office Technology, vol. 42, Issue 11, p. 14 (Nov. 1997).

"Put It on My Tab," Printing Expressions; 45, 10; ABI/INFORM Global, p. 46 (Mar. 2003).

"Tag and Label Move Through Quality Control Process," Quality Progress, vol. 37, Issue 7, p. 97 (Jul. 2004).

"Technology Showcase," Managing Office Technology, vol. 42, Issue 12, p. 32 (Dec. 1997).

Cross, R.G., "Tear Off Bar for Perforated Continuous Forms," IBM Technical Disclosure Bulletin, pp. 2205-2206 (Nov. 1978).

Denton, S., This filing system is as easy as ABC; [1,2,6,7 Edition], The San Diego Union-Tribune, San Diego, California, p. F8 (Jul. 10, 2002).

Eichorn, R.N., "No Burst Or Cut, Continuous Forms," IBM Technical Disclosure Bulletin, pp. 10-11 (Sep. 1962).

International Search Report and International Preliminary Report for PCT/US2011/038294, filed May 27, 2011.

Redpath, S.D., "System Notebook Visual Rendition," IBM Technical Disclosure Bulletin, pp. 225-226 (Jul. 1992).

Scott, P., Back-to-school gear: cool, smart and maybe too much fun; [1,2,3,4,5 Edition], The San Diego Union-Tribune, San Diego, California, p. E4 (Aug. 28, 1993).

Web page, Google http://www.google.com, featuring "Index Tabs Your Way, Fast" by SimPro, Inc., www.simpro-Qroducts.com (Sep. 2008).

Web page, http://www.alibaba.com, featuring "Tab Divider, Index Tab, Transparent Index Tab, PP Tab Divider" (Oct. 2008).

Web page, http://www.carstens.com, featuring "9-Tab Blank All White Poly Chart Divider Set for Side-Opening Ringbinder Chartholders" (Oct. 2008).

Web page, http://www.nextag.com, featuring "Avery Nos. 1-5 Tab Executive Dividers, Multi Color"—Oct. 1, 2008.

Web page, http://www.sears.com, featuring "ACCO View Tab Transp. Dividers" (Oct. 2008).

Web page, http://www.shoplet.com, featuring "Smead Mortgage File Folders w/Dividers" (Oct. 2008).

Web page, www.bizrate.com featuring "Miscellaneous Binders and Accessories" (Sep. 2008).

* cited by examiner

EDGE TABS FOR NOTEBOOK

REFERENCE TO RELATED APPLICATION

This application is a continuation of U.S. patent application Ser. No. 16/788,441, filed Feb. 12, 2020, now issued as U.S. Pat. No. 11,027,569, which is a continuation of U.S. patent application Ser. No. 13/265,886, filed Oct. 24, 2011, now issued as U.S. Pat. No. 10,596,845, which is a U.S. national phase application filed under 35 U.S.C. § 371 of International Application No. PCT/US2011/038294, filed May 27, 2011, designating the United States, which claims the benefit of priority under 35 U.S.C. § 119(e) of U.S. provisional application Ser. No. 61/349,549 filed on May 28, 2010 which are hereby incorporated by reference in their entirety.

BACKGROUND

The present invention is directed to a notebook, and more particularly, to a notebook having tabs received along a bound edge or corner adjacent a bound edge.

Tabs may be used to identify and locate sections of a notebook, binder, or the like. Such tabs may be placed upon sheets or pages, or upon dividers, positioned within a notebook or binder. The tabs may extend beyond the periphery of the dividers or pages, to be more accessible to the user. However, this may expose the tabs to wear and tear, and increase the overall size of the notebook or binder.

Bound notebooks that currently exist and provide sectional dividers with tabs, do so on non-bound edges, and typically protrude beyond the edge of the sheet portion of a content item. In addition, and to point this out specifically, these tabs protrude beyond the edge of the content so they can be seen such that they provide a visible means of identification for the location and purpose of that particular location. (For example, in a 5 subject notebook, the tabs are typically used for identification of different subjects or sections within the notebook, and to provide the benefit of locating and turning to a desired section). As these tabs are protruding, they are exposed to various aspects of abuse or damage resulting from normal use, such as pushing into a backpack, storage locker, briefcase, etc. In some cases, the front and/or rear covers of the notebook are extended to provide some measure of protection for the tabs, but extended covers also partially obstruct the user's view and increase the overall size of the product. Alternately, in some books many of the pages themselves may have cut away portions to reveal divider pages, as in the case of old style dictionaries, where small portions of pages arc cut away to reveal letters ("A", "B", "C" etc) on divider pages or on the first page of each letter section of the dictionary.

Many notebooks (for example, school notebooks) contain a content sheet of a given size, and some notebooks contain a sheet that can be removed along a pre-perforated line parallel and near the bound edge, and this sheet can be required to be a given size. Because of this, any tab functionality is required to exist beyond the size of the sheet, so as not to interrupt the contiguous size of the sheet. In the dictionary example mentioned above, the cutouts do interrupt the contiguous size of the sheet.

Thus, it may be desired to provide tabs, which are accessible to the user without greatly increasing the overall size of the notebook or binder, and which are better protected from wear and tear.

The notebook disclosed herein provides several advantages. A sectional tab functionality exists within the bounds of the notebook while still providing visibility to the tabs, and full functional benefit of locating and turning to the desired section. The front cover and sheet contents, not the rear cover necessarily, are cut away to provide visibility and functional access to tabs that protrude in this cutaway area. In notebooks that have removable sheet functionality, the removed sheet typically is required to be, or desired to be, of a standard or relevant size, and the sheet as-bound into the notebook is extended along the bound edge to provide space for the binding itself. The feature of this invention exists within the 'as-bound-in' sheet size, but outside the 'removed sheet' size.

SUMMARY

The present disclosure in one aspect provides a notebook or binder with a tab or set of tabs located near a corner of and along a bound edge of the notebook or binder.

In one embodiment, a bound assembly of sheets includes a plurality of sheets each having a bound edge extending in a first direction and at least one hole proximate to the bound edge with a binding at the bound edge, the binding passing through at least one hole in each sheet and a first one of the sheets having a tab portion along the bound edge that extends further outward than the perimeter of a second one of the sheets.

In some embodiments, the binding does not extend entirely across the tab portion. In some embodiments, the tab portion may be manipulated to open the bound assembly to the first sheet.

In some embodiments, the bound assembly has an upper corner and a lower corner at opposed ends of the bound edge, and the tab portion is located at the upper corner or lower corner. In some embodiments, the tab portion is located along the bound edge at a position apart from the upper and lower corners.

In some embodiments, a first sheet comprises a plurality of unbound edges, at least one of the unbound edges comprising an identifying feature associated with the tab portion. In some embodiments the identifying feature is at least one of a color, a pattern, a shape or printed indicia. In some embodiments, the identifying feature is a portion of the first sheet that is outward-extending along an edge other than the bound edge.

In some embodiments, the binding is one of a spiral wire, a twin wire, sewing, staples, adhesive, or at least one ring that passes through or binds at least a portion of the length of the sheets at a bound edge, but not passing through or binding at least a second portion of the sheet length at the bound edge.

The present disclosure in a second aspect provides tabs to use with a bound-edge-tabbed notebook or binder.

In one embodiment of this aspect, a divider tab has a body portion to overly sheets in a notebook or binder, a spine portion extending within a volume defined at least partly by the binding, and at least one aperture or slit to receive a ring of the binding.

In some embodiments, the divider tab may be adapted to receive at least one ring of a spiral wire binding.

In some embodiments, the divider tab may be adapted to receive at least one ring of a twin wire binding.

In some embodiments, the divider tab may be adapted to receive at least one ring of a ring binder.

In some embodiments, the divider tab may be removable from a ring to which it attaches.

In other embodiments the divider tab may not be removable from a ring to which it attaches.

In some embodiments, the divider tab may include a flag portion extending outward beyond sheets in a notebook, and outside the volume of the binding.

A set of dividers is also disclosed, including at least a first divider and a second divider, where the distance between the spine and flag portion of the first divider is different than the distance between the spine and flag portion of the second divider.

DETAILED DESCRIPTION

Figure 1:
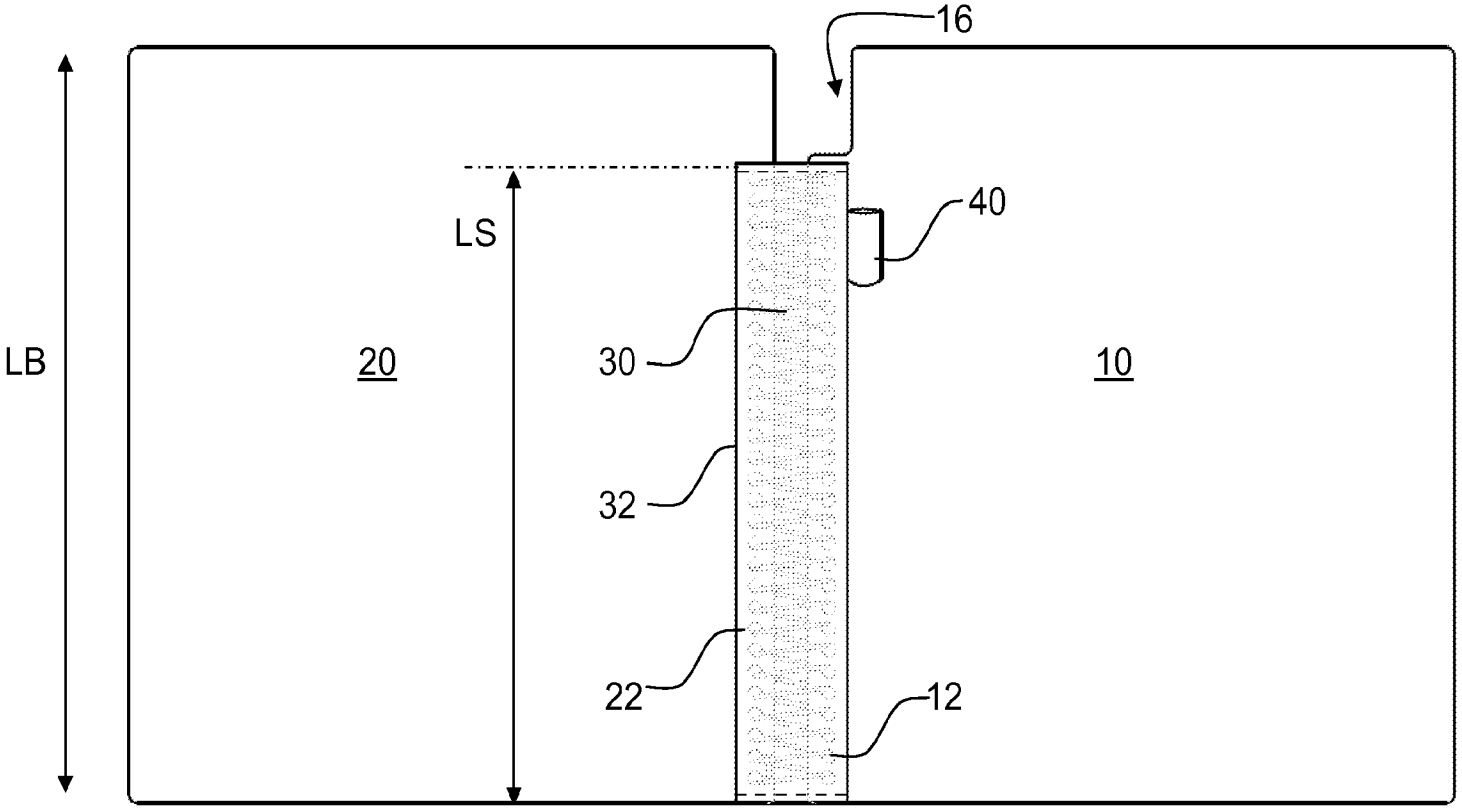
FIG. 1 is an exterior view of a notebook cover incorporating a cutaway for access to corner tabs, in an open position.

FIG. 1 illustrates an exterior view of a notebook cover incorporating a cutaway for access to corner tabs, in an open position. The notebook cover may include a front cover 10 and rear cover 20, bound together by a binding 30 such as a spiral wire binding threaded through holes 12 and 22 provided in the front cover 10 and rear cover 20. A binding sleeve 32 may be provided to cover the outer part of the binding 30. The binding sleeve 32 may, for example, be a fabric material such as used in a SPIRAL GUARD® notebook manufactured by MeadWestvaco Corporation. A writing instrument holder 40 may be provided on the binding sleeve 32 or attached to front cover 10 or rear cover 20.

The length LS of the binding sleeve 32 may be less than the length LB of the notebook, for example by stopping the binding sleeve 32 short of the top end (as shown), bottom end, or both ends of the notebook. Also, the binding sleeve may be discontinuous, for example present at top and bottom ends of the notebook, but not present at an intermediate region between the top and bottom ends. A cover access cutaway 16 may be provided in the front cover 10 as shown, or in the rear cover 20, or in both the front and back covers.

Figure 2:
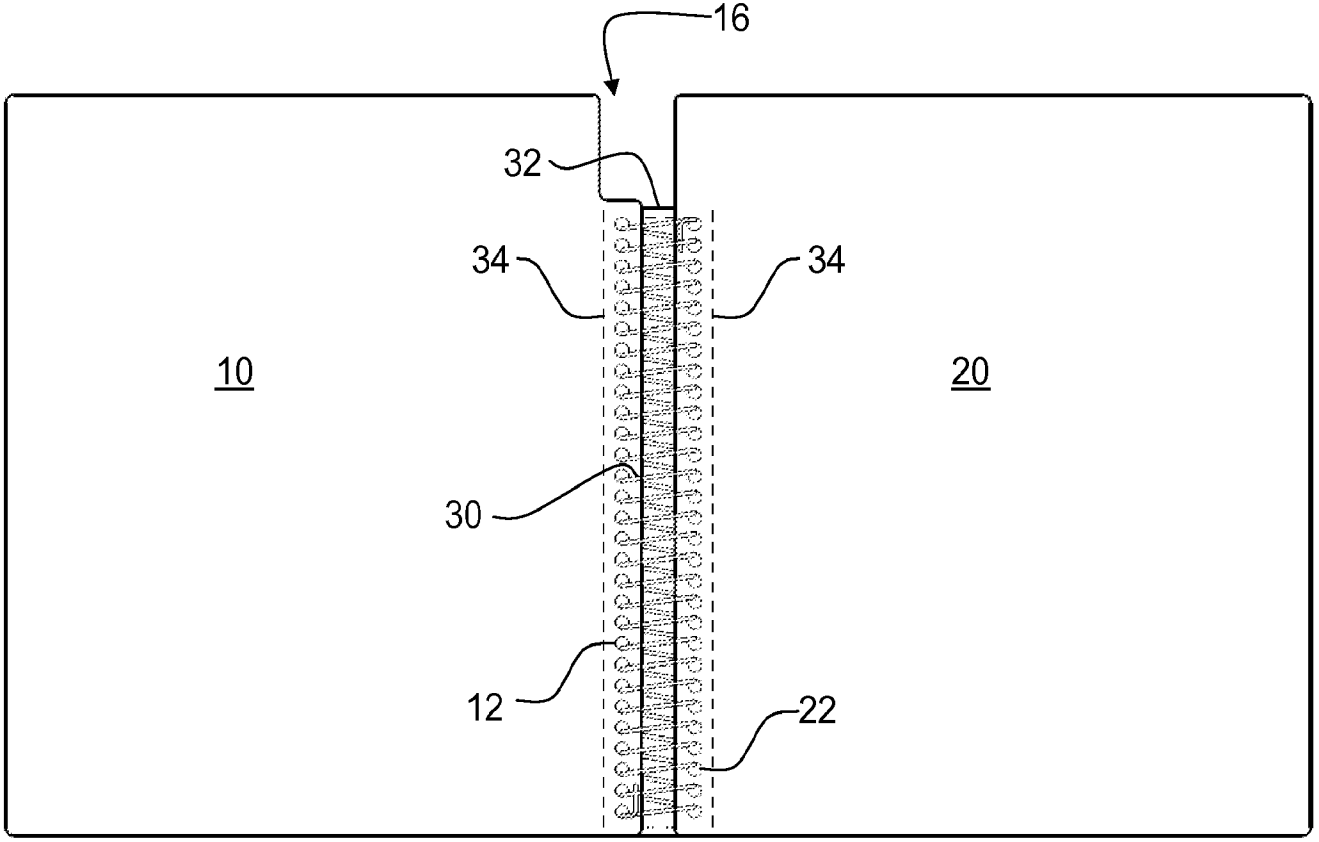
FIG. 2 is an interior view of the notebook cover of FIG. 1 in an open position.

FIG. 2 is an interior view of the notebook cover of FIG. 1 in an open position, showing many of the features already identified in FIG. 1. The binding sleeve 32 may be attached to the front cover 10 and rear cover 20 by any type of attachment, such as by stitching 34.

Figure 3B:
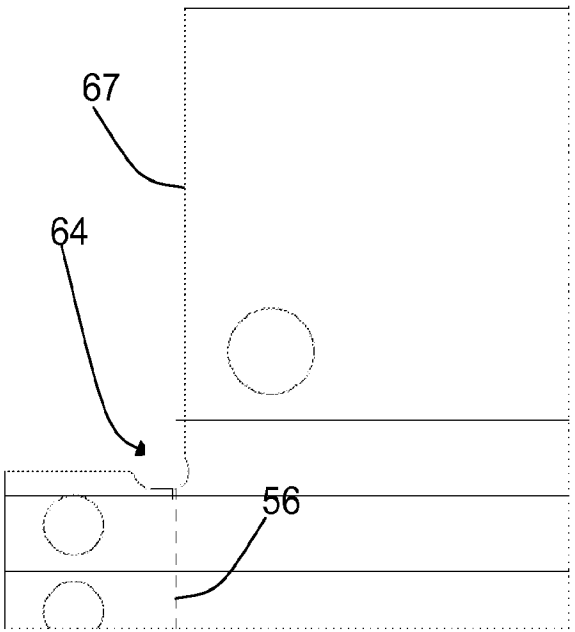
FIG. 3B is a detail view of a corner of the sheet of FIG. 3A.
Figure 3A:
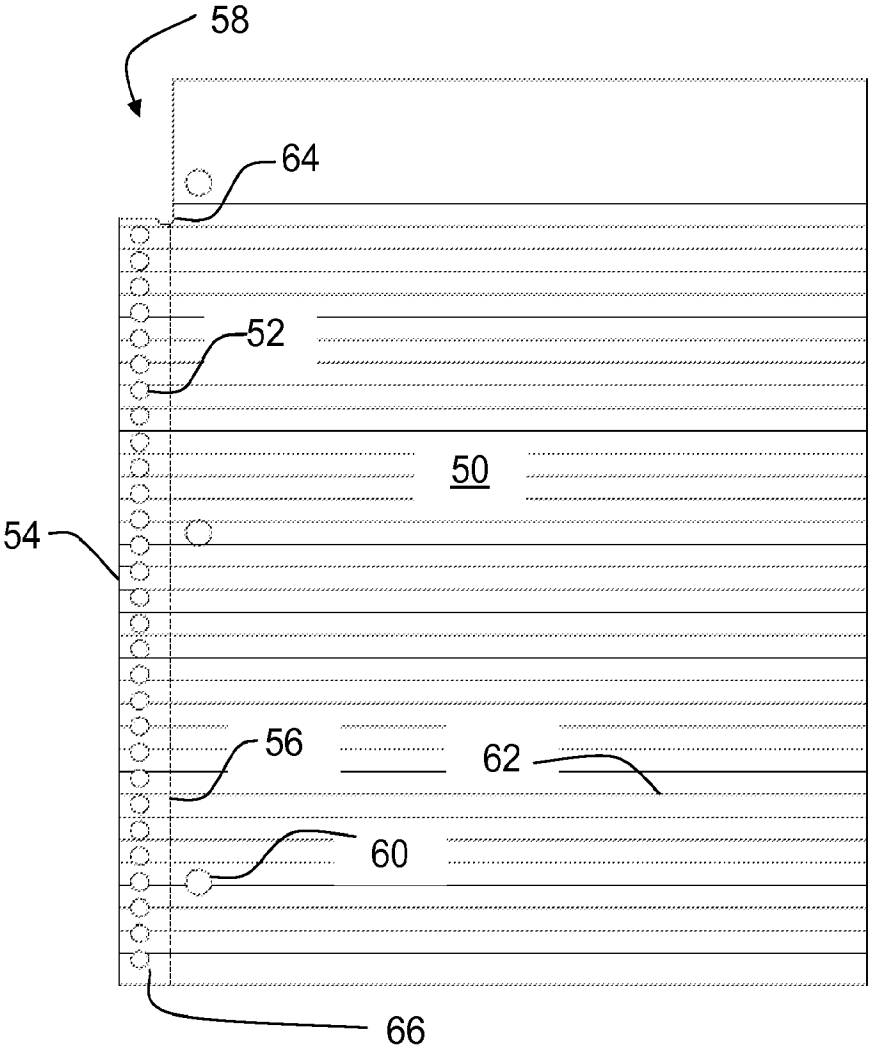
FIG. 3A is a plan view of a sheet to be received in the notebook.

FIG. 3A is a top view of a sheet 50 to be received in the notebook. The sheet 50 may have holes 52 along bound edge 54 to receive the binding 30. A perforation line 56 may be provided between the main part of the sheet 50 and the bound-in portion 66 of the sheet, to facilitate tearing the sheet neatly from the binding 30 if so desired. A sheet cutaway 58 may be provided at one or both ends of the sheet, (or in an interior length of the sheet along the binding) adjacent bound edge 54, and coinciding approximately with cover access cutaway 16. Sheet 50 may be provided with ring holes 60 for example to receive the rings of a ring binder or other type of binder. The sheet may also be provided with lines such as printed horizontal lines 62 or other lines (not shown). A relief area 64 may be provided adjacent the sheet cutaway 58. The relief area 64 may for example be a radius or rounded portion cut away from the sheet as shown in the detail view of FIG. 3B. Thus in a notebook where the pages are removable, no part of the removed sheet has to be cut away to show the tab, so that if a page is removed, it is a full page (e.g., an 8.5 inch by 11 inch sheet) without any cutaway. In manufacturing sheet 50, as shown in FIG. 3B, the cut line 67 defining an edge of cutaway 58 may be positioned slightly to the right of the perforation line 56 in order to allow for manufacturing tolerances. Also the relief area 64 may extend slightly to the right of perforation line 56. This slight tolerance cut or extension of the relief area 64 are not considered a "cutaway" herein as compared with the sheet cutaway 58. In some notebooks this perforation line 56 may not exist as the sheet is not intended to be removed, and therefore cutaway 58 can in fact interrupt the contiguous sheet.

Figure 4:
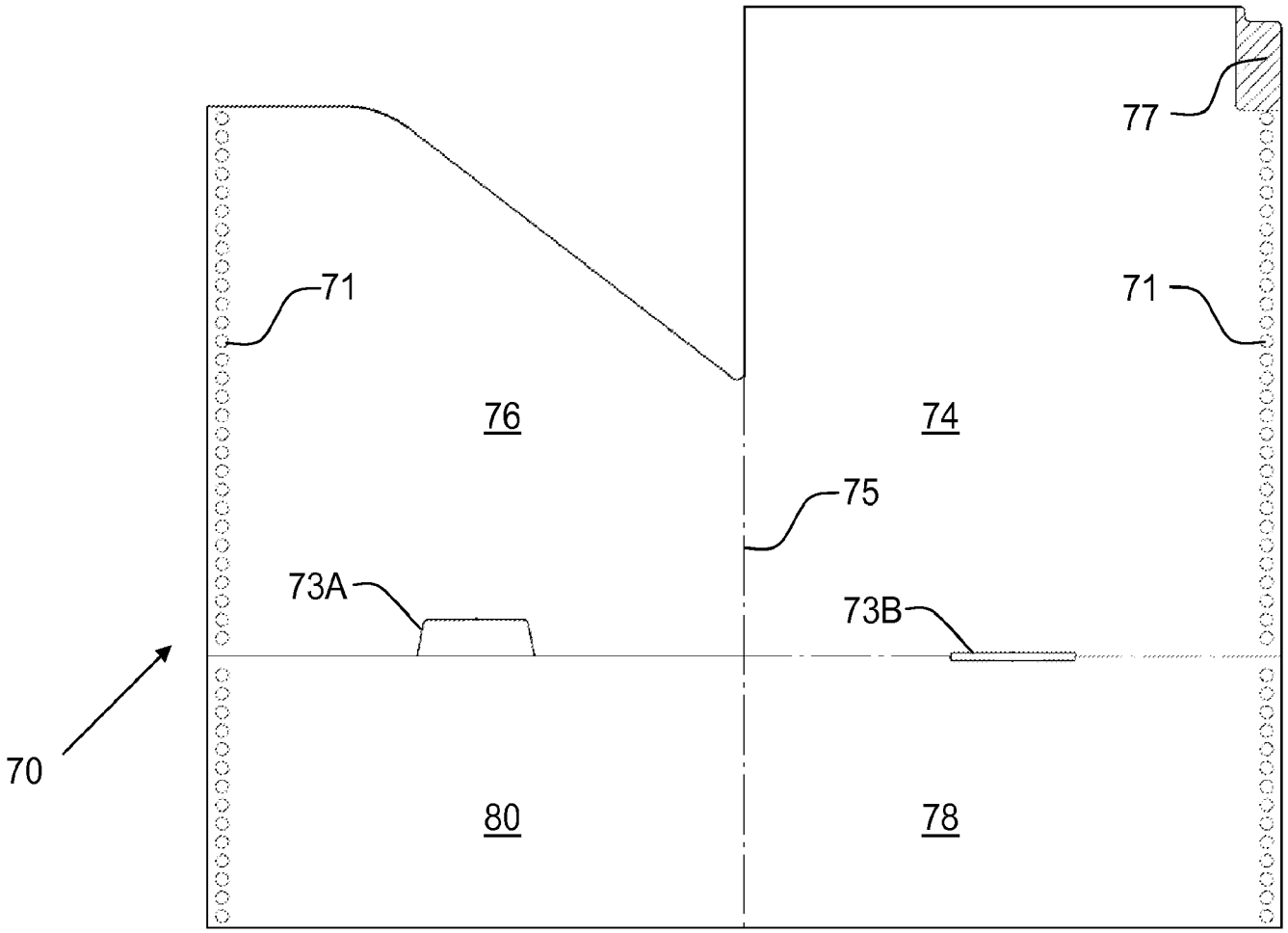
FIG. 4 is a plan view of a blank which can be folded to form a divider for the notebook of FIG. 1, the divider provided with a corner tab feature.
Figure 5B:
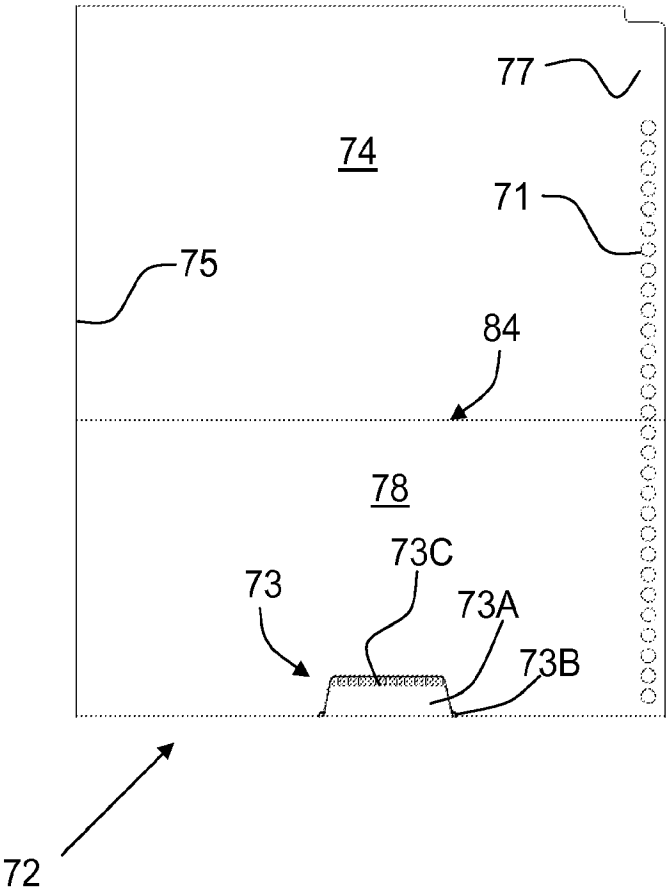
FIG. 5B is a plan view of the divider of FIG. 5A; seen from the other side.
Figure 5A:
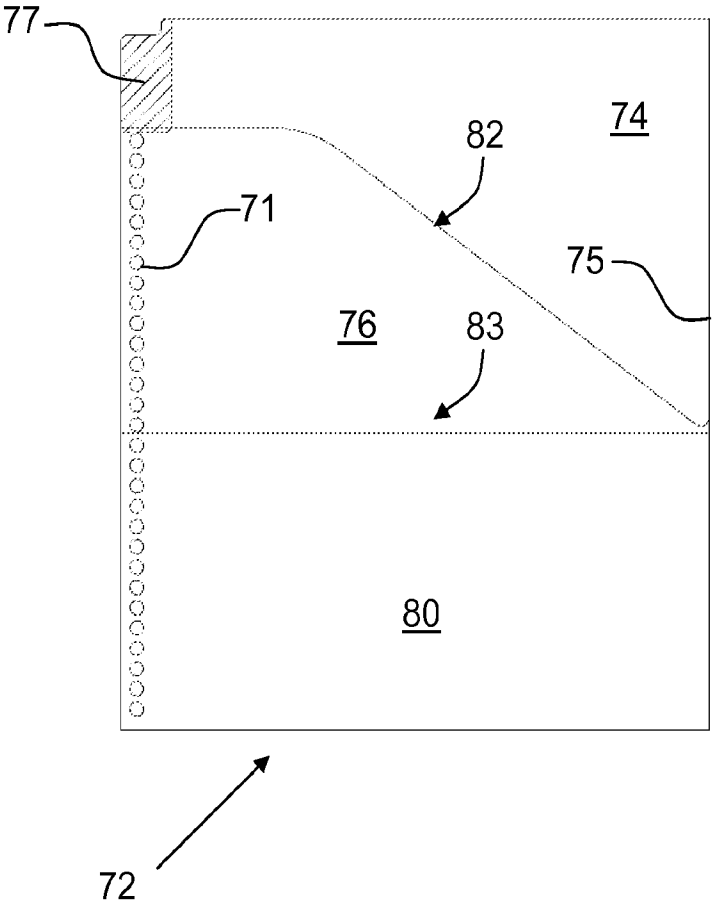
FIG. 5A is a plan view of a divider formed from the blank of FIG. 4, seen from one side, the divider provided with a corner tab feature.

FIG. 4 is a plan view of a blank 70 which can be folded to form a divider for the notebook of FIG. 1. The particular shape of the blank 70 is meant only as an example. The divider may be provided with a divider corner tab 77. The blank 70 may include divider major panel 74, divider minor panel 76, and divider pocket panels 78 and 80. The divider pocket panels may be folded upward and the divider major panel 74 and minor panel 76 folded along a fold line 75 to form the divider 72 shown in FIGS. 5A and 5B. FIG. 5A shows one side of the divider, which may include a slash pocket 82 formed between divider major panel 74 and divider minor panel 76, as well as a pocket 83 formed between minor panel 76 and divider pocket panel 80. FIG. 5B shows the reverse side of the divider, which may include a pocket 84 formed between major panel 74 and pocket panel 78.

The completed divider 72 may be closed along one side by fold line 75 and along the opposing side by the binding 30 being wound through holes 71. The bottom of pocket 82 may be closed by a glued, welded, or other type of attachment 73 along its lower edge. In the example shown in FIGS. 4, 5A and 5B, such an attachment 73 may include a flap 73A to secure panels together. There may be a cutaway 73B to provide clearance for flap 73A. A weld 73C may be used to secure flap 73A, or other attachment means may be used such as adhesive or mechanical fastener.

Figure 6:
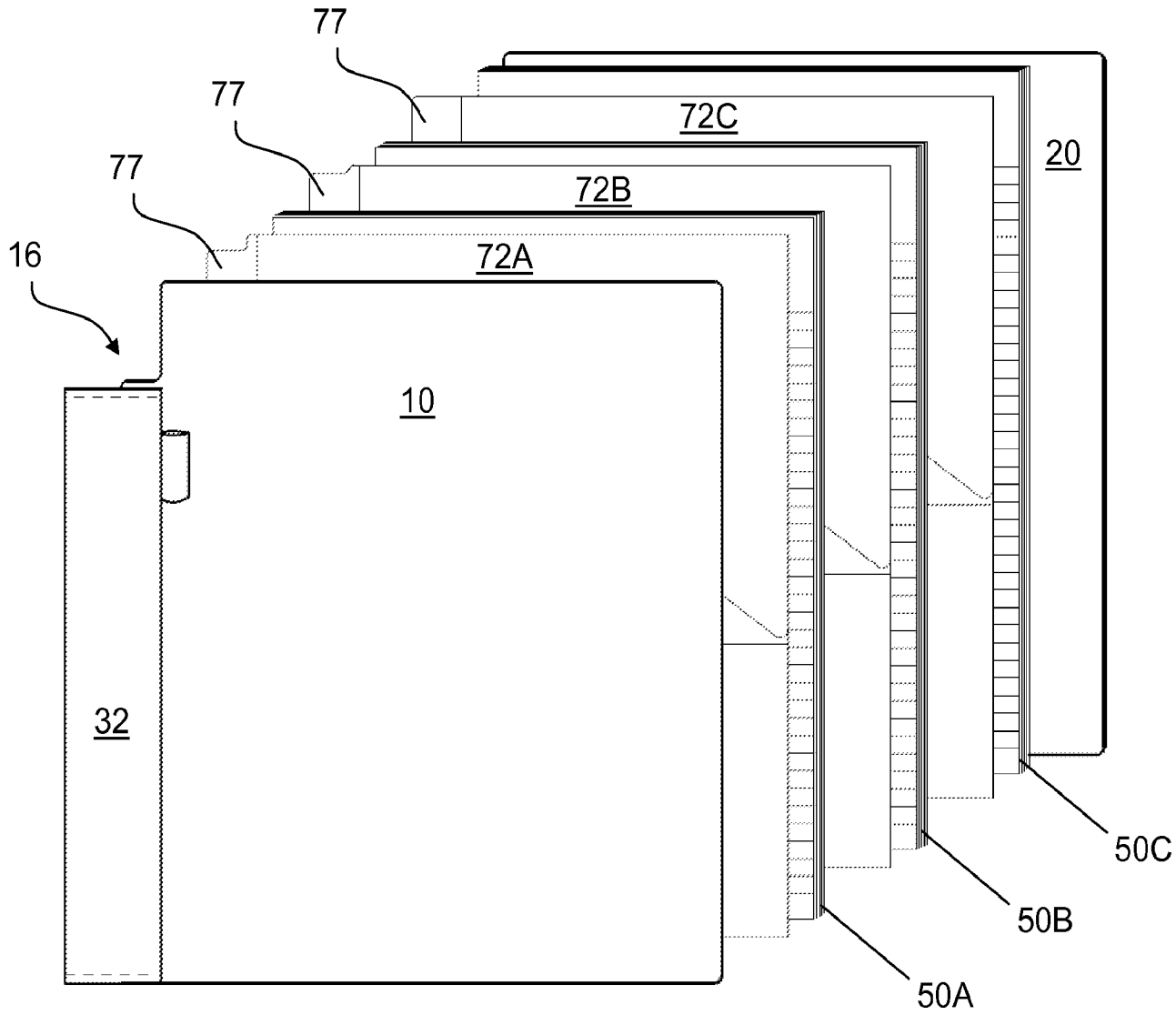
FIG. 6 is an exploded view of the notebook in a disassembled configuration, including dividers and sheet sets.

FIG. 6 is an exploded view of the notebook in a disassembled configuration, which may include covers, dividers, and sets of sheets. For example, starting with the front, the notebook may include front cover 10, first divider 72A, a first set 50A of sheets 50, a second divider 72B, a second set 50B of sheets, a third divider 72C, a third set 50C of sheets, and finally a rear cover 20. For example, sets 50A, 50B, and 50C may each include 50 sheets of paper.

It will be noted that the cover access cutaway 16 provides visual and tactile access to divider corner tabs 77. When the notebook is assembled, these corner tabs 77 are accessible to the user but do not necessarily extend beyond the general outline of the notebook. In this example the corner tabs 77 reside within a space that might otherwise be occupied by the binding 30 and/or binding sleeve 32, if the binding and binding sleeve were provided along the full length of the bound edge or the bound-in portion 66 of a sheet.

Figure 7:
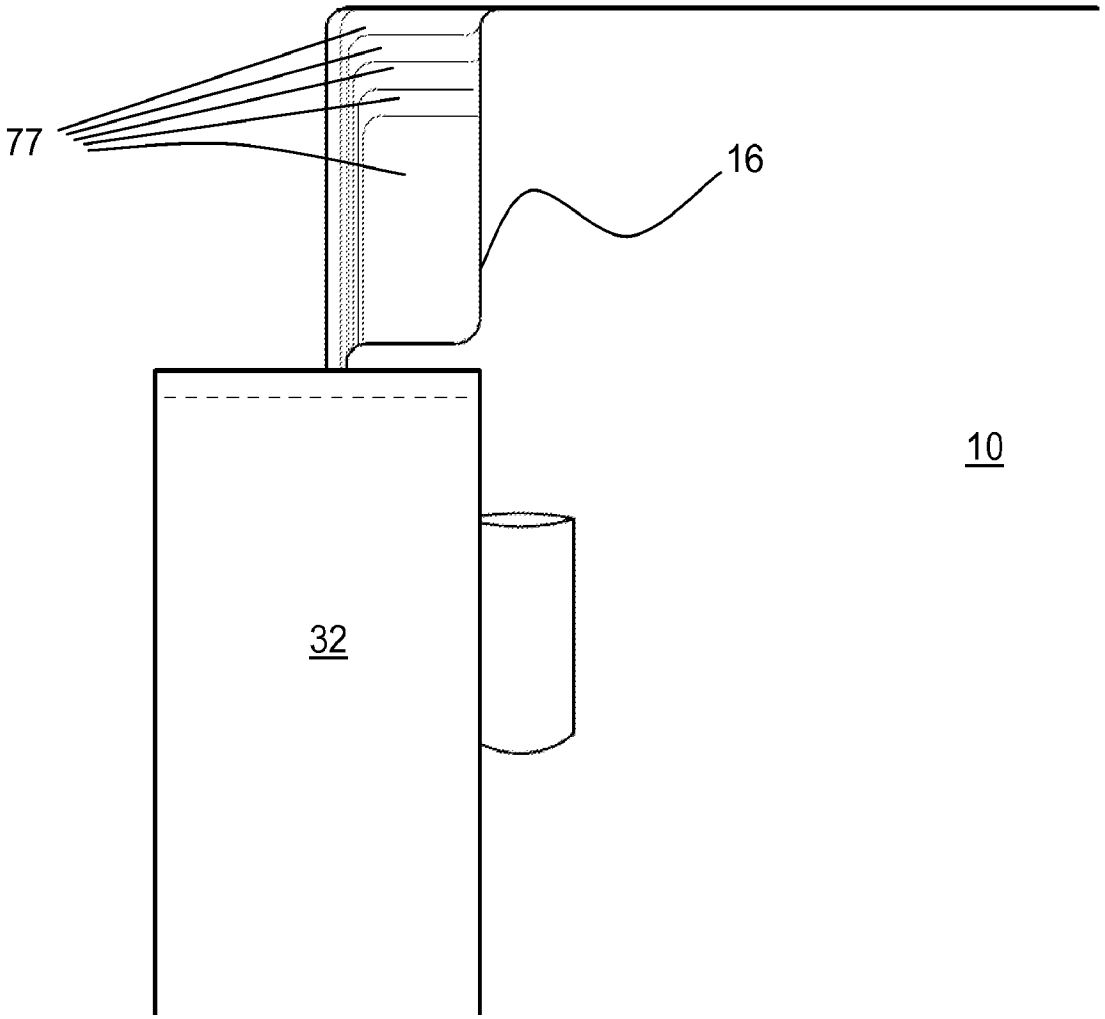
FIG. 7 is a plan view of a corner of the assembled notebook of FIG. 6, showing a detail of corner tabs thereon.

FIG. 7 is a plan view of an assembled notebook of FIG. 6, showing a detail of the corner tabs 77 which are located on the bound edge of the notebook but not covered by binding 30 or binding sleeve 32. The individual corner tabs 77 may be shaped, sized, positioned, colored, or otherwise made different from one another to allow the user to readily discern such differences. For example, the tabs may be offset from one another along the binding edge. Alternately, the tabs may be similarly shaped and/or positioned, or identically shaped and/or positioned. The sets 50A, 50B, 50C, etc of sheets may provide sufficient thickness to form a spaced separation between the individual corner tabs so that the user may readily tell them apart. Space may be provided on the corner tabs for the user to write information regarding the content of the notebook, such as the subject matter associated with each sets 50A, 50B, 50C, etc of sheets. To access a particular section of the notebook, the user may grasp the associated corner tab 77 or place a finger between tabs or between the attached dividers, and then open the notebook to the desired section. The tabs may also extend slightly outward on the upper or lower edge of the notebook.

With reference now to FIGS. 6 and 7, it will be understood that the tabs 77 may reside at least partly within a region or volume defined approximately by a binding. For example, in some cases the tabs may reside within an approximately cylindrical volume defined at least in part by a spiral binding (or twin wire binding, or even defined by one or more binding rings having a circular, rectangular, or other shape) where the cylindrical volume extends generally through the spiral (or twin wire, ring, or rings), and may extend beyond the spiral (or twin wire, ring, or rings) for example extending upward beyond the binding as in FIGS. 1-7. The location of the tabs 77 within this cylindrical volume protects the tabs and does not appreciably increase the size of the notebook. In some cases a binding other than a spiral, twin wire, ring, or rings may be used, for example a sewn, glued, stapled, riveted, type of binding. In these cases the binding itself may define a region or volume having a somewhat linear aspect (as for a stapled book with few pages) or a somewhat planar aspect (as for a sewn-binding book with many pages). Whether the binding has a linear or planar aspect, it may still be stopped short of either the top or bottom corner (or both) or interrupted within the bound edge apart from either corner, so that tabs 77 may be free of the binding (sewing, glue, staples, rivets, etc) at the interrupted point.

Figure 8:
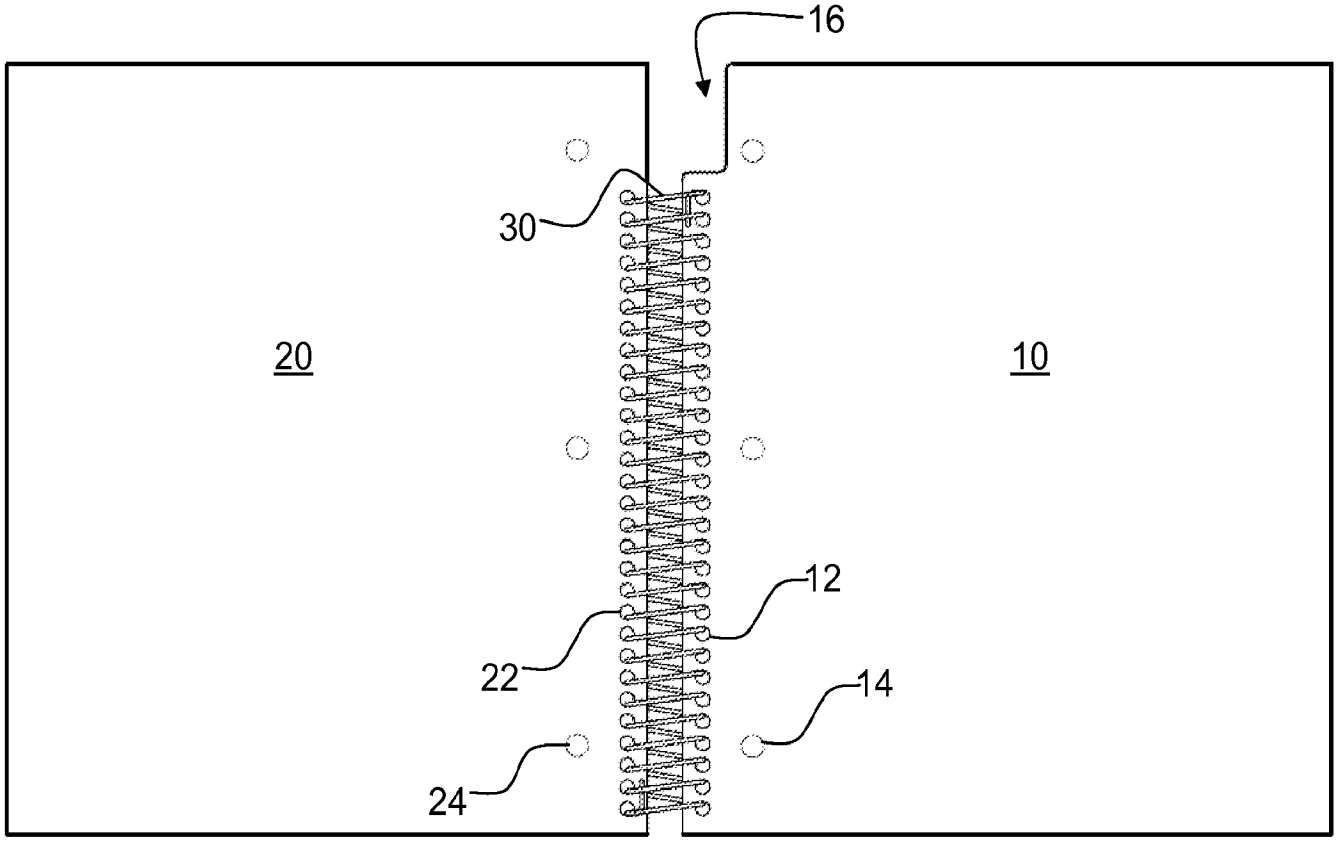
FIG. 8 is an exterior view of another notebook cover incorporating a cutaway for access to corner tabs, in an open position.

FIG. 8 illustrates an exterior view of a notebook cover similar to that in FIG. 1, but without a binding sleeve. The notebook cover may include a front cover 10 and rear cover 20, bound together by a binding 30 such as a spiral wire binding threaded through holes 12 and 22 provided in the front cover 10 and rear cover 20. Ring holes 14 and 24 may be provided on the front cover 10 and rear cover 20 respectively. Such ring holes could also have been provided on the cover shown in FIG. 1. A writing instrument holder (not shown) may optionally be provided on or attached to front cover 10 or rear cover 20. A cover access cutaway 16 may be provided in the front cover 10 as shown, or in the rear cover 20, or in both the front and back covers.

Figure 9:
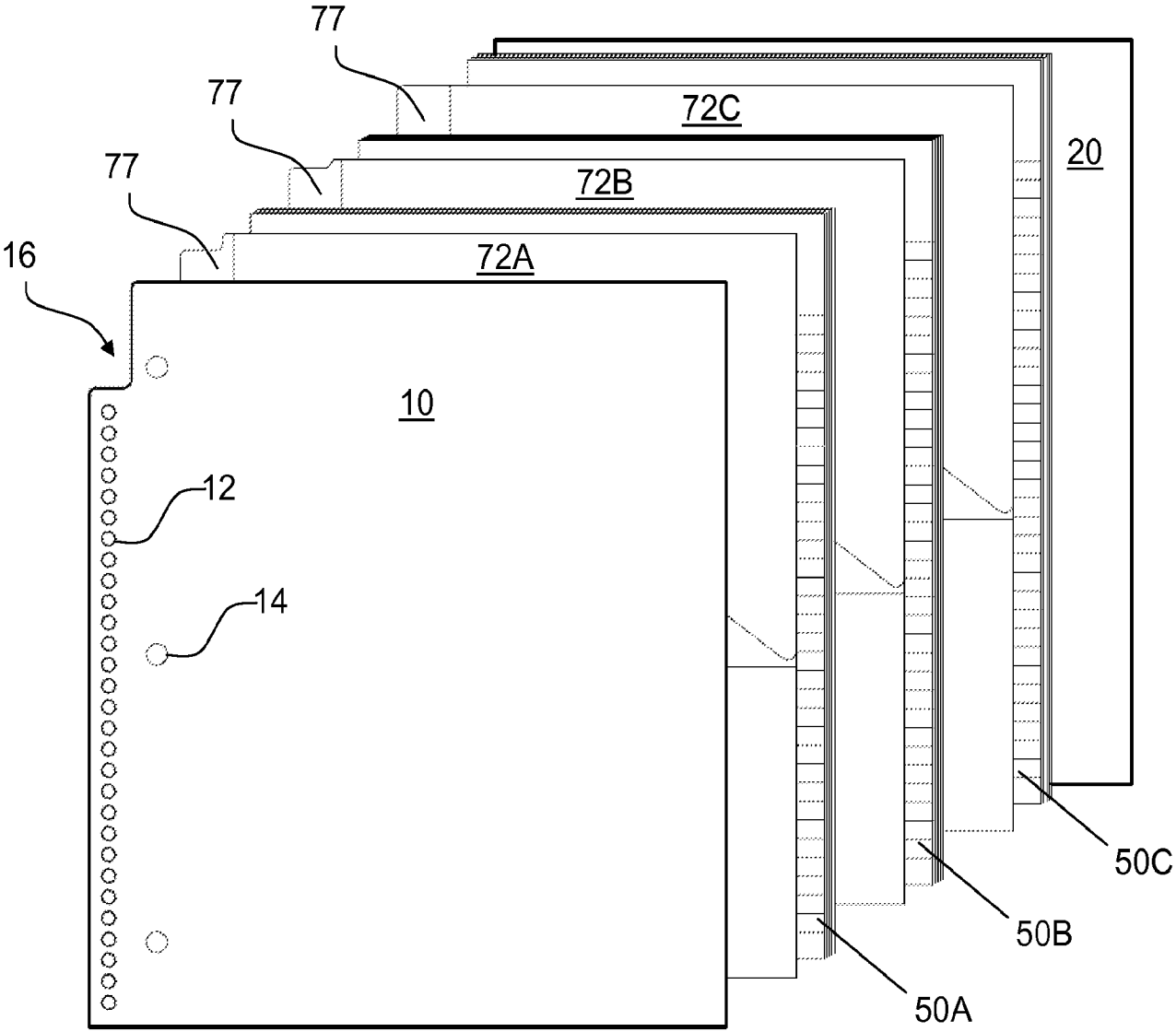
FIG. 9 is an exploded view of a notebook with the cover of FIG. 8, in a disassembled configuration, including dividers and sheet sets.

FIG. 9 is an exploded view of the notebook in a disassembled configuration, which may include covers, dividers, and sets of sheets. This notebook is similar to that shown in FIG. 6, but does not include a binding sleeve. As before, starting with the front, the notebook may include front cover 10, first divider 72A, a first set 50A of sheets 50, a second divider 72B, a second set 50B of sheets, a third divider 72C, a third set 50C of sheets, and finally a rear cover 20. For example, sets 50A, 50B, and 50C may each include 50 sheets of paper.

It will be noted that the cover access cutaway 16 provides visual and tactile access to divider corner tabs 77. When the notebook is assembled, these corner tabs 77 are accessible to the user but do not necessarily extend beyond the general outline of the notebook. In this example the corner tabs 77 resides within a space that might otherwise be occupied by the binding 30, if the binding was provided along the full length of the bound edge.

Figure 10:
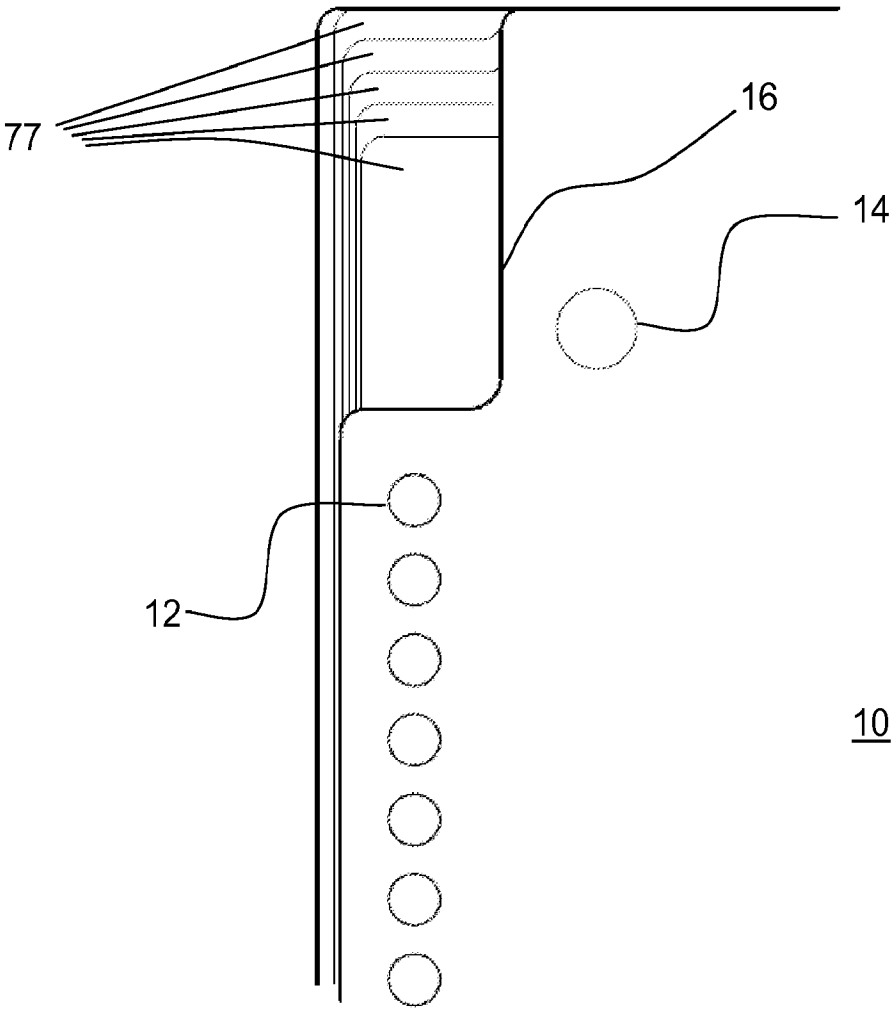
FIG. 10 is a plan view of a corner of the assembled notebook of FIG. 9, showing a detail of corner tabs thereon.

FIG. 10 is a front view of an assembled notebook of FIG. 9 (except for binding 30 which is not shown but would utilize holes 12 or alternately, ring holes 14, along with associated holes inside the notebook) showing a detail of a corner tabs 77 which are located on the bound edge of the notebook but not covered by binding 30. The individual corner tabs 77 may be shaped, sized, positioned, colored, or otherwise made different from one another to allow the user to readily discern such differences. For example, the tabs may be offset from one another along the binding edge. Alternately the tabs may be similarly shaped and positioned. The sets 50A, 50B, 50C, etc of sheets may provide sufficient thickness to form a spaced separation between the individual corner tabs so that the user may readily tell them apart. Space may be provided on the corner tabs for the user to write information regarding the content of the notebook, such as the subject matter associated with each sets 50A, 50B, 50C, etc of sheets. To access a particular section of the notebook, the user may grasp the associated corner tab 77 or place a finger between tabs or between the attached dividers, and then open the notebook to the desired section. The tabs may also extend slightly outward on the upper or lower edge of the notebook.

Figure 11:
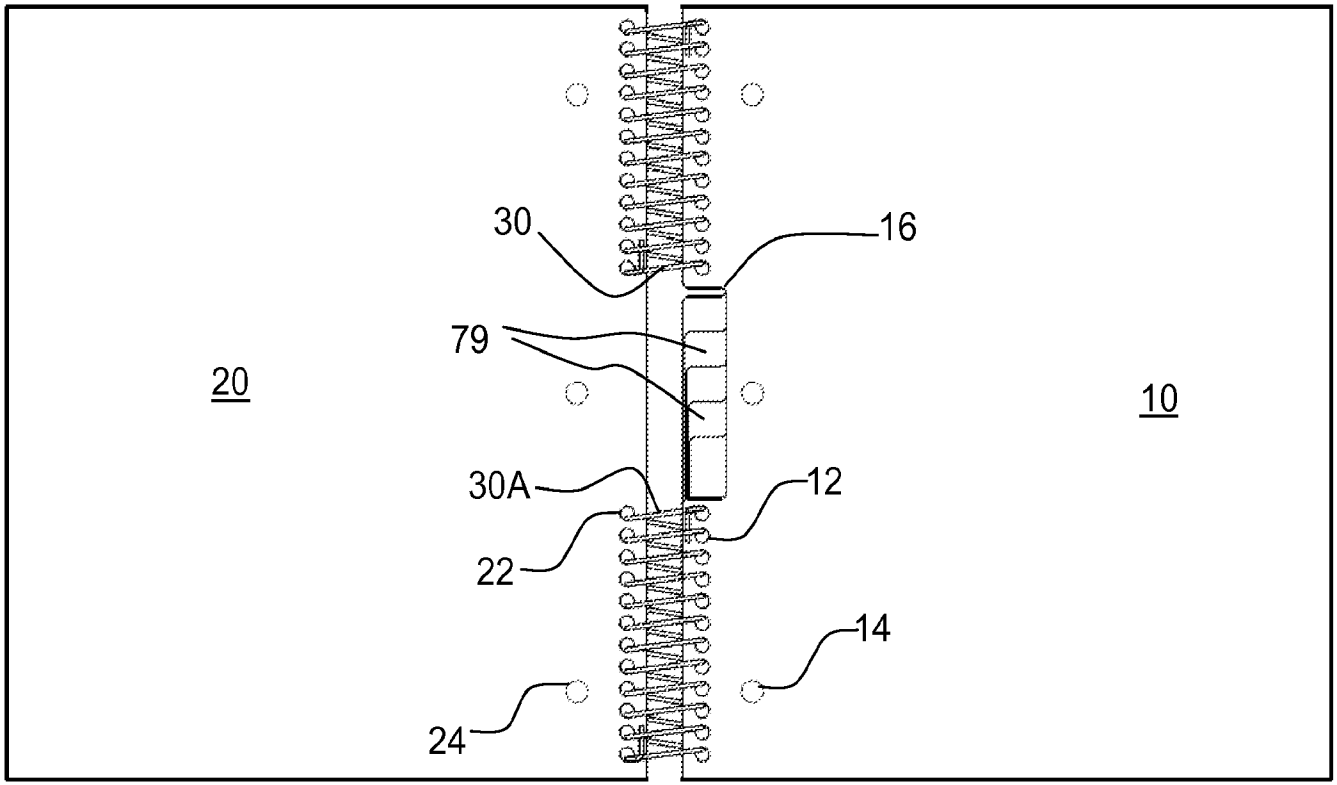
FIG. 11 is an exterior view in an open position of another notebook cover incorporating a cutaway for access to tabs located away from a corner.

FIG. 11 shows a front, open view of a notebook with bound-edge tabs 79 and cover access cutaway 16 located apart from the corners of the notebook. The binding may be discontinuous, for example a first length of spiral binding 30 at the upper end of the notebook and a second length of spiral binding 30A at the lower end of the notebook. The cover access cutaway 16 may be located in the front cover 10 as shown, or in the rear cover 20, or in both covers. Many other features are shown that are previously described in relation to FIGS. 1 and 8.

Figure 12:
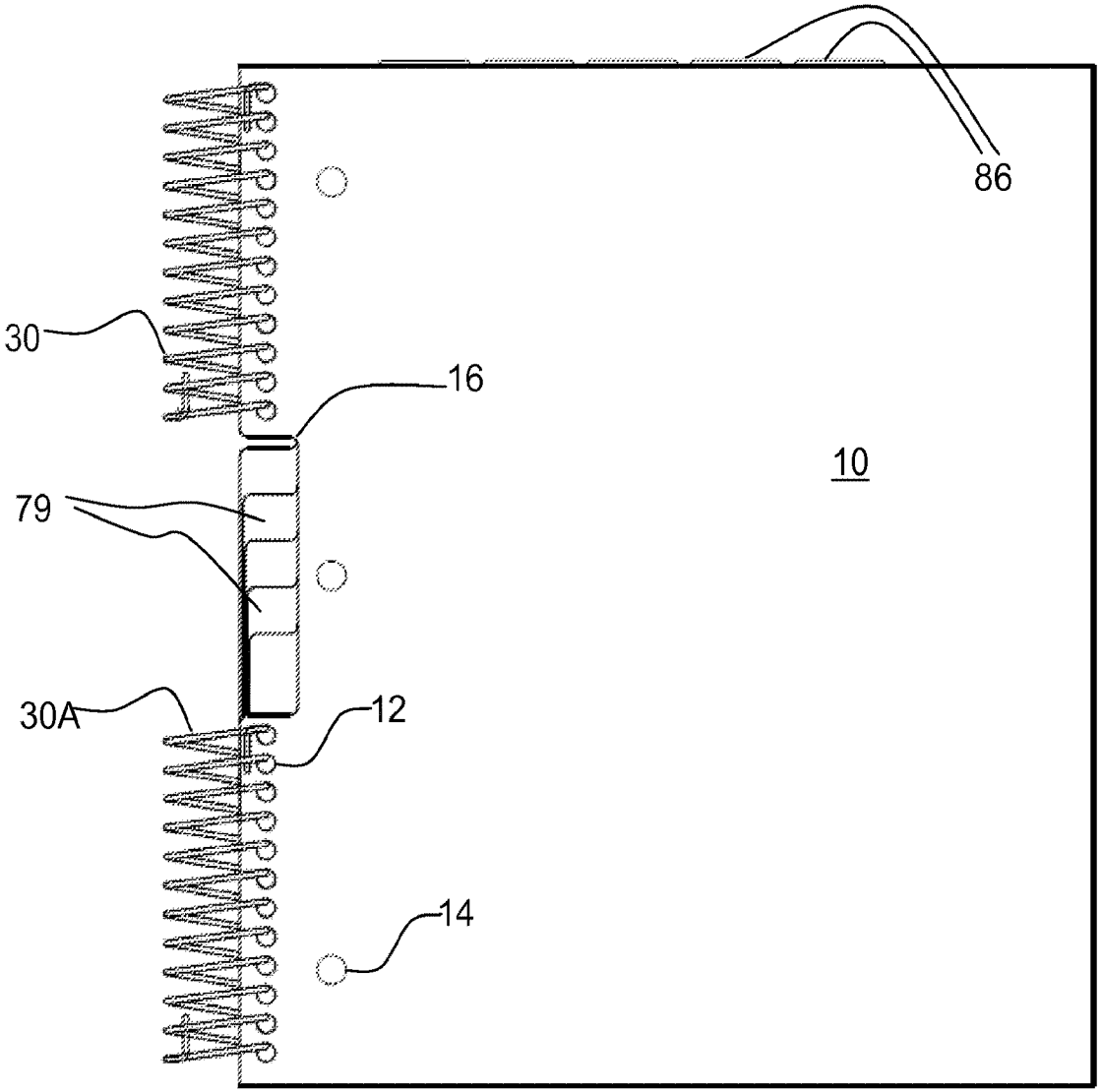
FIG. 12 is an exterior view in a closed position of the notebook of FIG. 11.

FIG. 12 shows a closed view of the notebook of FIG. 11. Also shown are flag portions 86 associated with each of the bound-edge tabs. The flag portions 86 may be helpful for opening the notebook to a given section. Information displayed on tabs 79 along the spine may be associated with the flag portions 86 by use of a variable property such as color or pattern. The flag portions 86 may thus be quite short and only extend slightly beyond the usual upper boundary of the notebook.

Figure 13:
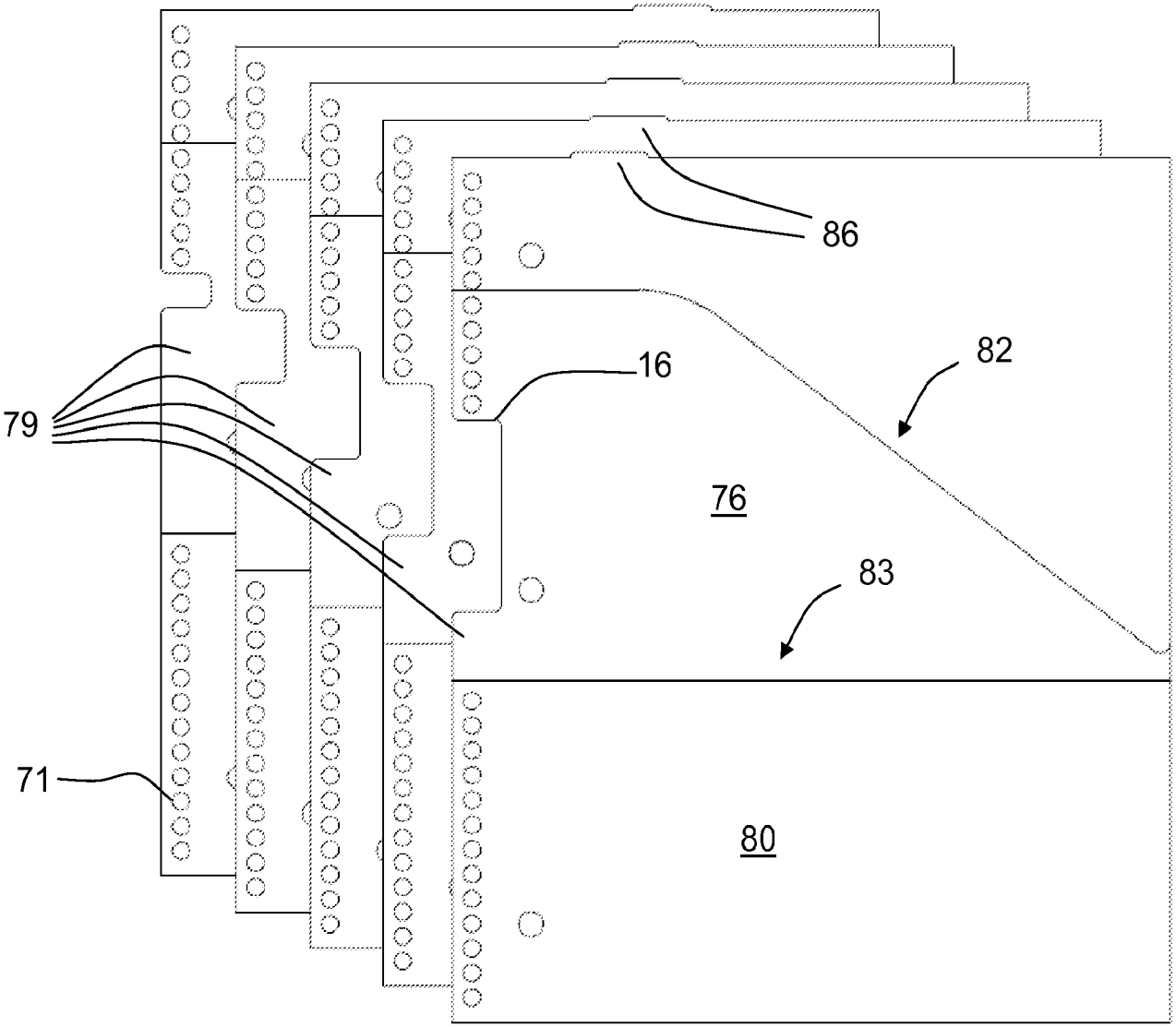
FIG. 13 is a plan view of several dividers for use in the notebook of FIG. 12.

FIG. 13 shows an exploded view of several dividers for use in the notebook of FIG. 11. As seen, the size of the cutaway portion 16 may be varied between dividers, as may the location of the flag portions 86.

Figure 14:
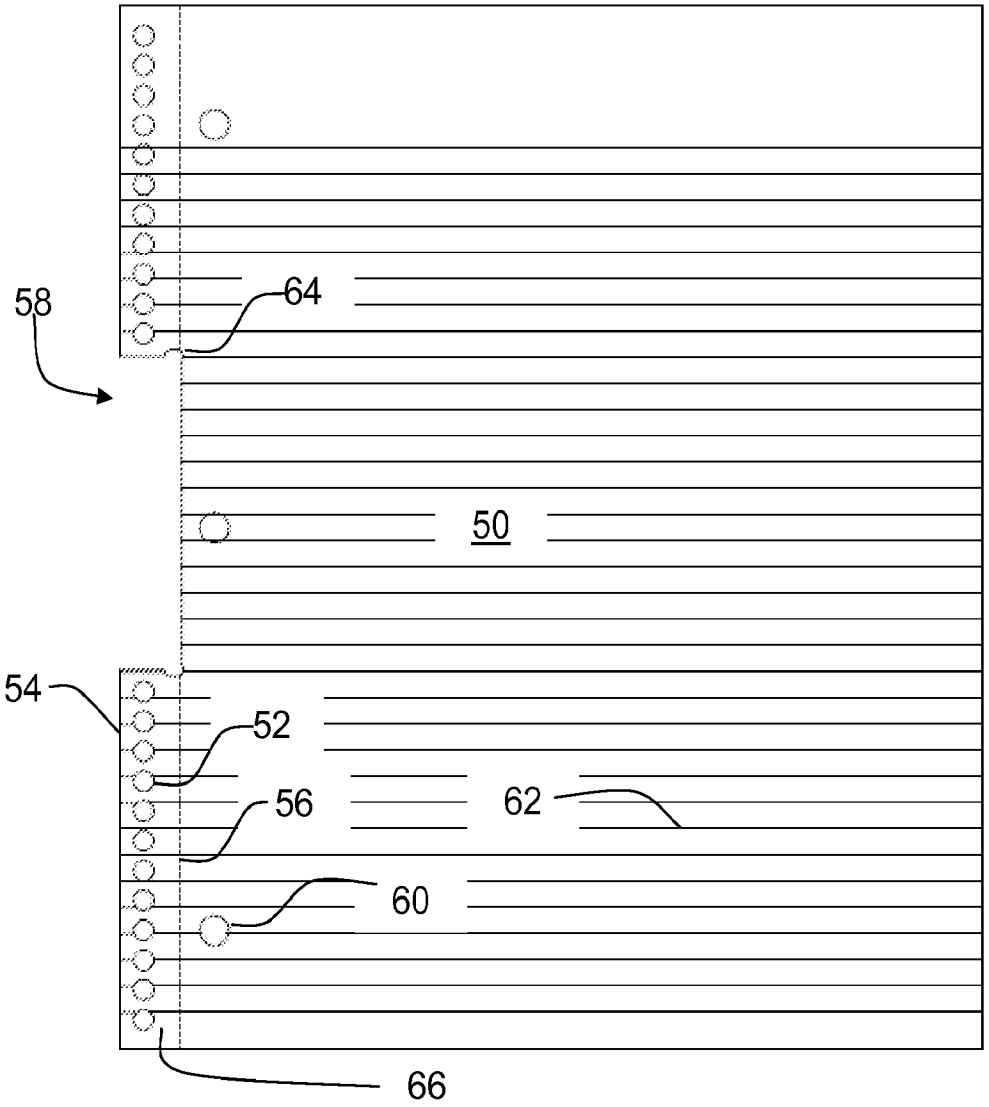
FIG. 14 is a plan view of sheet for use in the notebook of FIG. 12.

FIG. 14 shows a page for use in the notebook of FIG. 11, with the sheet cutaway 58 located apart from the corners of the notebook.

Figure 15B:
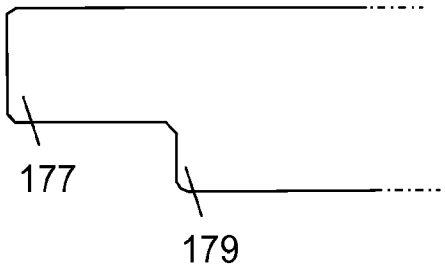
FIG. 15B is a variation on the divider of FIG. 15A.
Figure 15A:
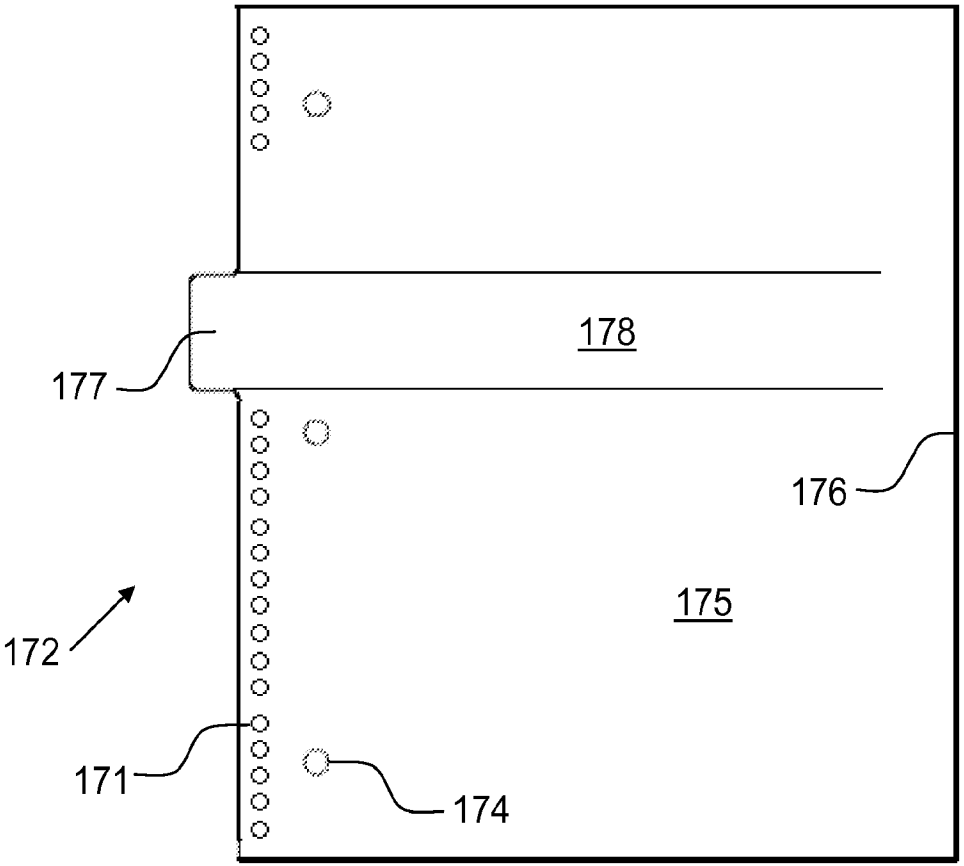
FIG. 15A is a plan view of an alternative divider for use in the notebook of FIG. 12.

FIG. 15A shows another type of divider 172 for use in the notebook of FIG. 11. Tab 177 is contiguous with or connected to a tab strap 178 which extends at least partway toward an unbound edge of the notebook. Tab strap 178 may be formed as a part of divider sheet 175, either by providing slits as shown, or by a folding process (not shown), or tab 177 and tab strap 178 may be provided separately and then attached to divider sheet 175. For example, if the divider is made by folding a blank of material as shown in FIG. 4, the tab and tab strap may be designed into the blank. As shown in FIG. 15B, the tab strap 178 may have a shoulder 179 somewhat wider than tab 177, to prevent the tab strap from being pulled very far in the direction of the binding. The divider 172 may have other features such as holes 171 for receiving a binding such as a spiral wire, and holes 174 for receiving a ring type of binding.

Figure 16A:
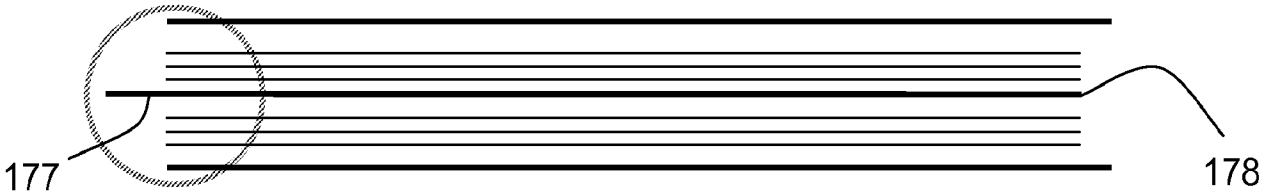
FIGS. 16A-C show several steps in the use of the divider of FIG. 15B.
Figure 16B:
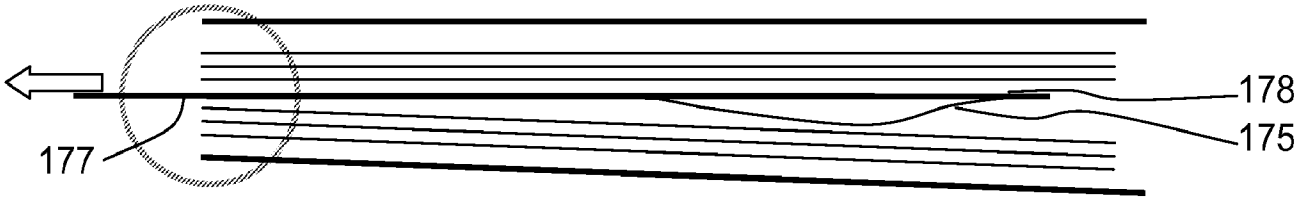
Figure 16C:
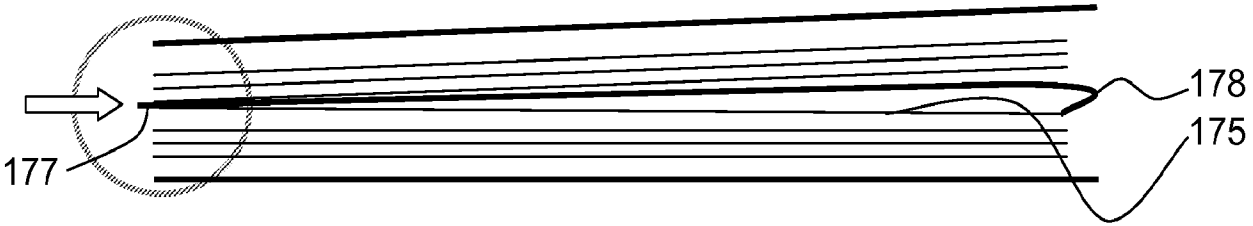

One method for use of tab 177 is shown in FIGS. 16A-16C. As shown in FIG. 16A, tab 177 is accessible in the region of the binding. FIG. 16B shows how, when tab 177 is pulled toward the left, the attachment of tab strap 178 to divider sheet 175 may cause divider sheet 175 to warp or buckle slightly, thus opening the unbound edge 176 of the notebook to the desired page. To withstand the force of this method, tab 177, tab strap 178, and divider sheet 175 may be made of a strong material that withstands tension and warping without tearing or creasing. FIG. 16C shows an alternative method of using tab 177, where the tab is pushed causing the tab strap to warp or buckle slightly near the unbound edge, opening the notebook to the desired page. In this method, tab 177 and tab strap 178 may be made of a relatively stiff material so as not to buckle before the edge warping occurs. The width of tab strap 178 may be made narrower (not shown) or the tab strap material made thinner (not shown) at some point, for example near the unbound edge 176, or the tab strap may be otherwise weakened near the unbound edge, for example by perforating, folding, or scoring, to encourage warping to occur there rather than elsewhere along the length of the tab strap. The tab strap may be made of a material such as plastic or coated paper that slides easily between the divider sheet and any adjacent sheets or pages. If the divider has multiple plies, such as divider 72 shown in FIGS. 5A and 5B, the tab strap may be run between plies. With divider 72, placing the tab strap between plies may minimize interference with the pockets.

Figure 17B:
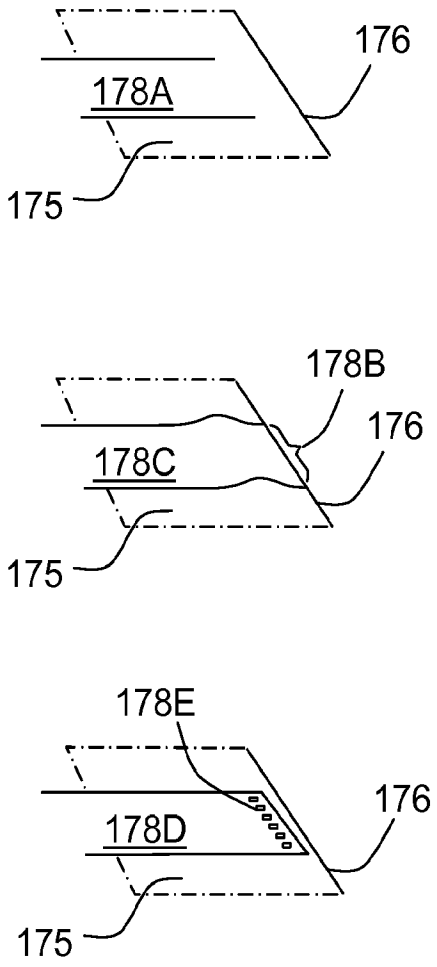
FIG. 17B shows perspective views of additional variations on the divider of FIG. 15A.
Figure 17A:
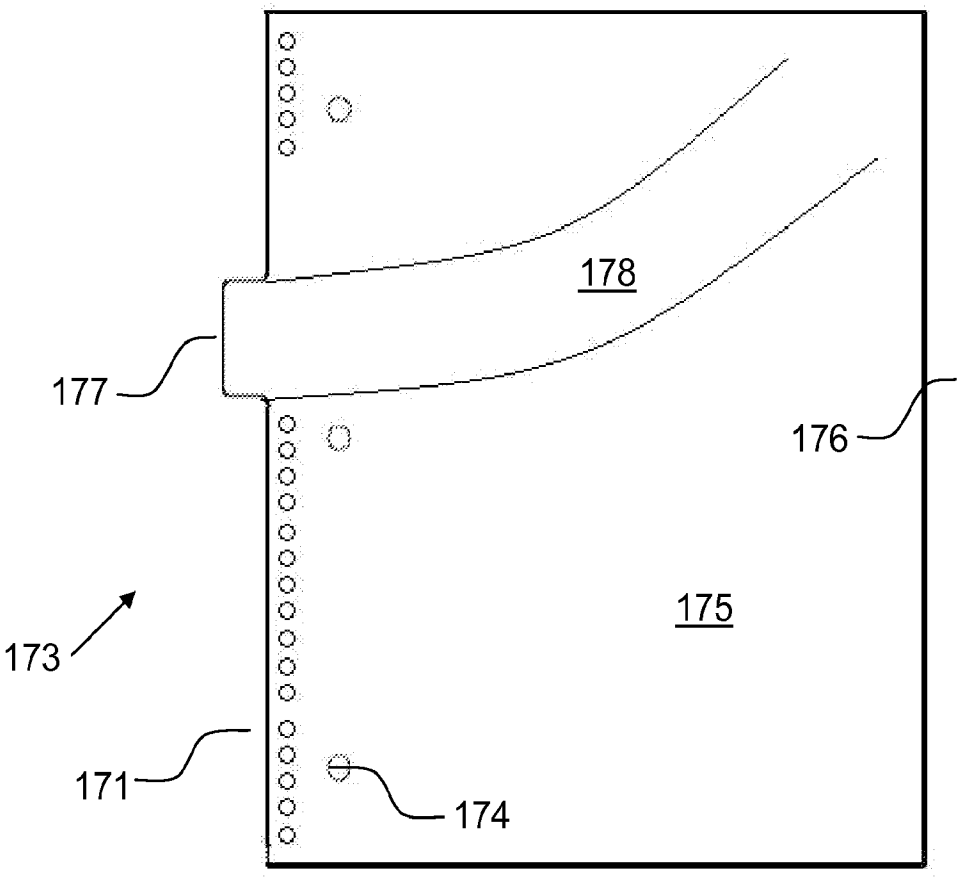
FIG. 17A shows another variation on the divider of FIG. 15A.

FIG. 17A shows a divider 173 whose design is similar to FIG. 15A, but where the tab strap 178 extends toward an upper edge or corner of the notebook.

FIG. 17B shows perspective views of a variety of divider designs. For example the divider sheet may be slit (as already shown on FIG. 15A) to form tab strap 178A. The divider sheet may be folded or creased about a fold 178B at or near unbound edge 176 to form tab strap 178C. A separate piece of material may be used to form tab strap 178D that may be attached to the divider sheet at or near unbound edge 176 by glue 178E (or welding, stapling, or other suitable attachment).

Figure 18B:
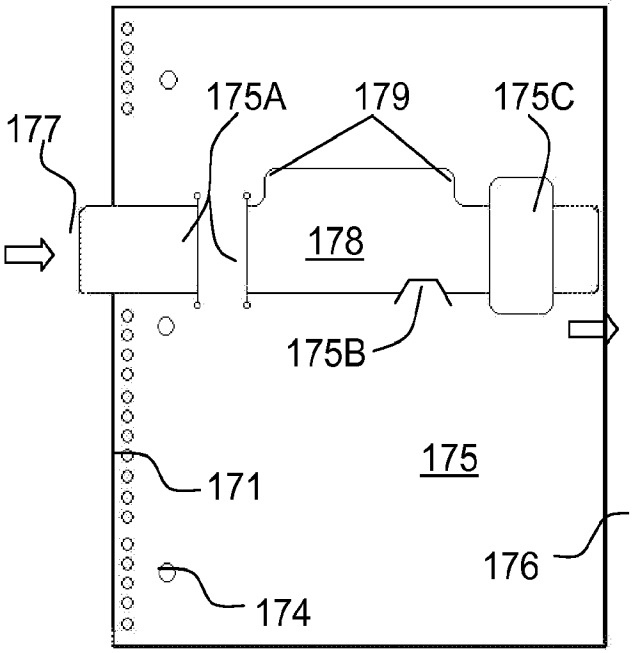
FIG. 18B shows another variation on the divider of FIG. 15A.
Figure 18A:
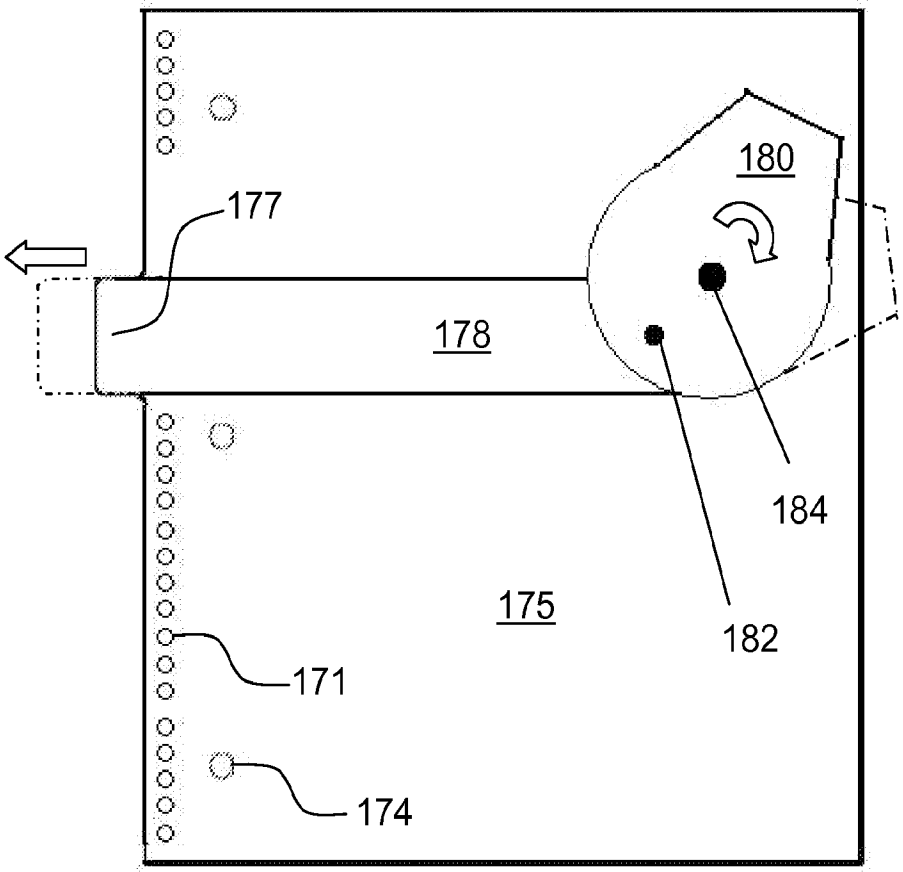
FIG. 18A shows another variation on the divider of FIG. 15A.

FIG. 18A shows a divider design which is similar to FIG. 15A, but where pulling on the tab 177 causes the tab strap 178 to rotate a cam 180 outward from the unbound edge to be used as a handle for opening the notebook to the page. The tab strap 178 may be attached to cam 180 by a pivot 182 such as a rivet, and the cam 180 may be attached to divider sheet 175 by another pivot 184. Alternately, the pivots may be located so that pushing on tab 177 causes cam 180 to rotate outward.

FIG. 18B shows another divider where the tab 177 and tab strap 178 may be separate from divider sheet 175, for example, formed from a separate piece of material. Pushing on tab 177 then may cause tab strap 178 to move toward unbound edge 176 and extend outward from the unbound edge to provide a marker or a handle by which to open the notebook to the divider sheet. The tab strap 178 may pass through one or more guide slits 175A and/or 175B formed in the divider sheet 175. Alternately or in addition, one or more guide straps 175C may be provided, for example as straps of material attached at one or both ends to divider sheet 175 to allow tab strap 178 to pass between the guide strap 175C and the divider sheet 175. One or more shoulders 179 may be provided to limit the movement of tab strap 178.

Figure 19B:
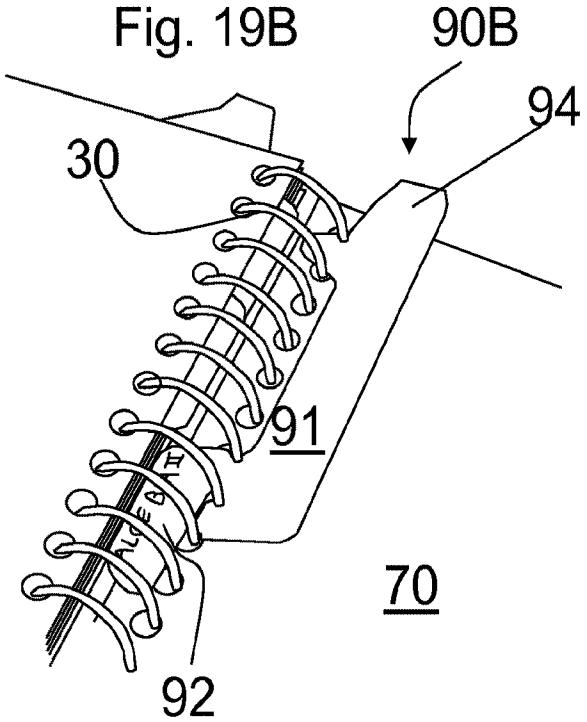
FIGS. 19A-19C are front perspective views of removable tabs for use with the notebook which exist inside the binding system without interrupting it.
Figure 19A:
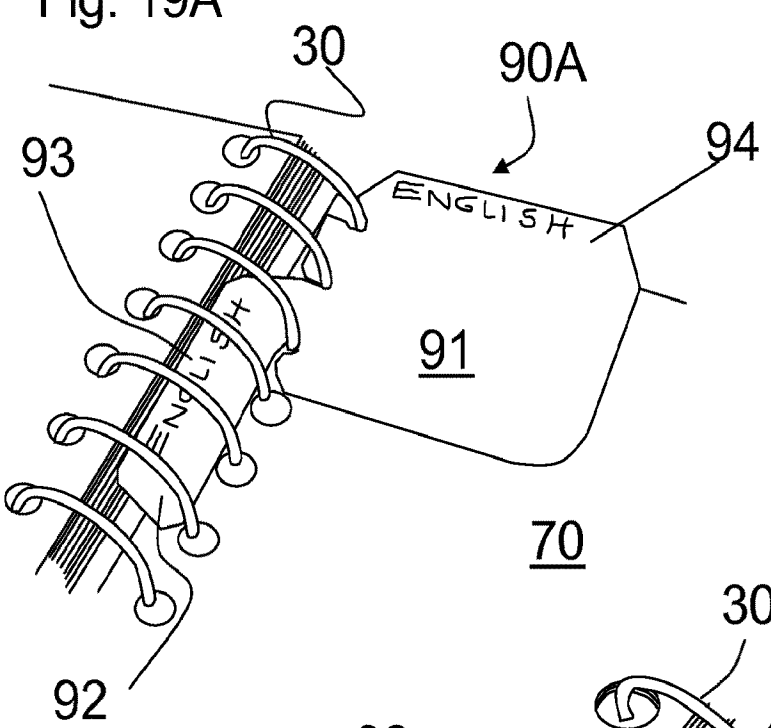
Figure 19C:
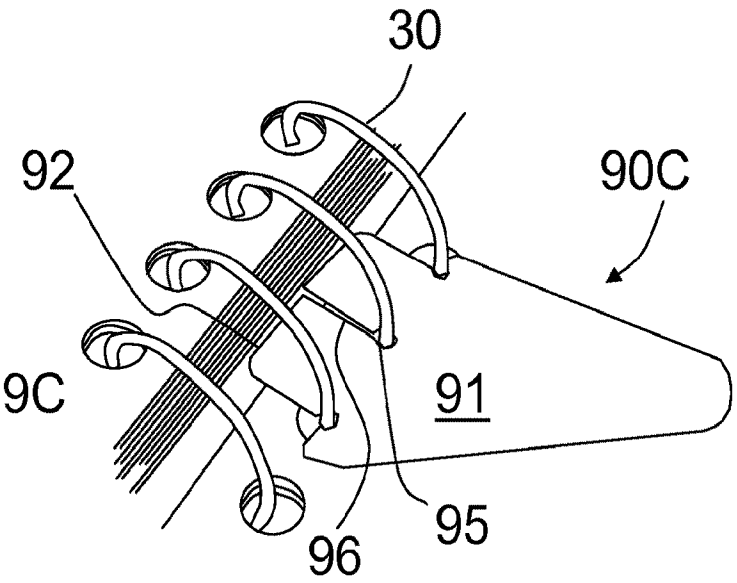

FIGS. 19A-19C are front perspective views of removable tabs 90A, 90B, 90C for use within a notebook. These particular tabs may be used with a binding 30 that extends along the full length of the bound edge of the notebook as shown, or a binding that extends only partially along the bound edge (as in FIG. 1). Each of the tabs may include a body portion 91 that may be located "within" the notebook sheets, that is located generally away from the bound edge, relative to binding 30. Thus the body portion 91 may generally overlie the area of the sheets 50 that is written upon by the user. Such overlap may be small, for instance generally within the sheet margin as shown in FIGS. 19A-19C, although the overlap may extend further onto the sheet. As shown for each of corner tabs 90A, 90B, and 90C, a spine portion 92 of the removable tab may be located within the cylindrical space of the binding 30, so that spine portion 92 and any information 93 (for example on FIG. 19A) thereon may be visible from outside the notebook, but with the spine portion 92 completely within the existing size of the notebook, and protected from wear and tear by binding 30. Thus the spine portion may extend partly beyond the bound edge of at least one sheet 50. Although no binding sleeve is used in the examples on FIGS. 19A-19C, a binding sleeve might be utilized if it did not obscure the tabs, or if the sleeve was transparent. As shown with removable tabs 90A and 90B, a flag portion 94 of the removable tab may extend outward slightly at the end of the notebook, for example, at the top end (as shown) or at the bottom end. Flag portion 94 may provide a grasping point from which a user may open the notebook to a particular section. However, flag portion 94 may not need to extend very far beyond the general boundary of the notebook pages, because it is not necessary to provide space for identifying information on flag portion 94, since information 93 is provided on spine portion 92. Individual colors may be used for each removable tab so that the information 93 on spine portion 92 is readily associated with the flag portion 94.

The length of the removable tab may be varied, for example the distance between spine portion 92 and flag portion 94 may be varied so that spine portion 92 of different tabs is located at different points along the bound edge. This may make the spine portion 92 visible and distinct as compared with other tabs. Furthermore, the flag portion 94 may be located close to the bound edge as shown in FIGS. 19A and 19B, or further away from the bound edge. The width of the flag portion 94 along the top edge may also be varied, as may the length of the spine portion 92 along the bound edge. Instead of or in addition to be being located at the top edge as shown in FIGS. 19A-19B, the tabs may be located along the bottom edge of the notebook.

The different styles of removable tabs 90A, 90B, and 90C (or other styles) may be used in combination if desired. For example removable tab 90A may be used with removable tab 90B, since their individual spine portions 92 occupy different positions along the binding 30 while yet having their individual flag portions 94 extending to the end of the notebook. Removable tab 90C may be used alone, or with tab 90A and/or tab 90C. Removable tab 90C may provide a particular convenience insofar as it may be located anywhere along binding 30 since it has no flag portion.

The removable tabs 90A, 90B, and 90C (or other styles) may be removably attached as shown in FIGS. 19A-19C, for example by providing holes or apertures 95 or slits 96 which receive at least one turn of a binding 30. Such apertures 95 may be somewhat open for example when located at an edge of a tab, or generally closed as when located apart from an edge of a tab, such generally closed apertures may be open to an edge through a slit. Thus a user may customize a notebook by varying the location of tabs within the pages of a notebook, and or the position along the binding edge. The user may likewise choose the style (e.g. shape, pattern, color) of particular tabs, and may write or otherwise attach information 93 onto the tabs, either on the body portion 91, the spine portion 92, or the flag portion 94.

Alternately, the tabs may be installed by the notebook manufacturer, but still be removable by the user for customization of the notebook. As another alternative, the tabs may be installed by the notebook manufacturer but not be removable.

Figure 20:
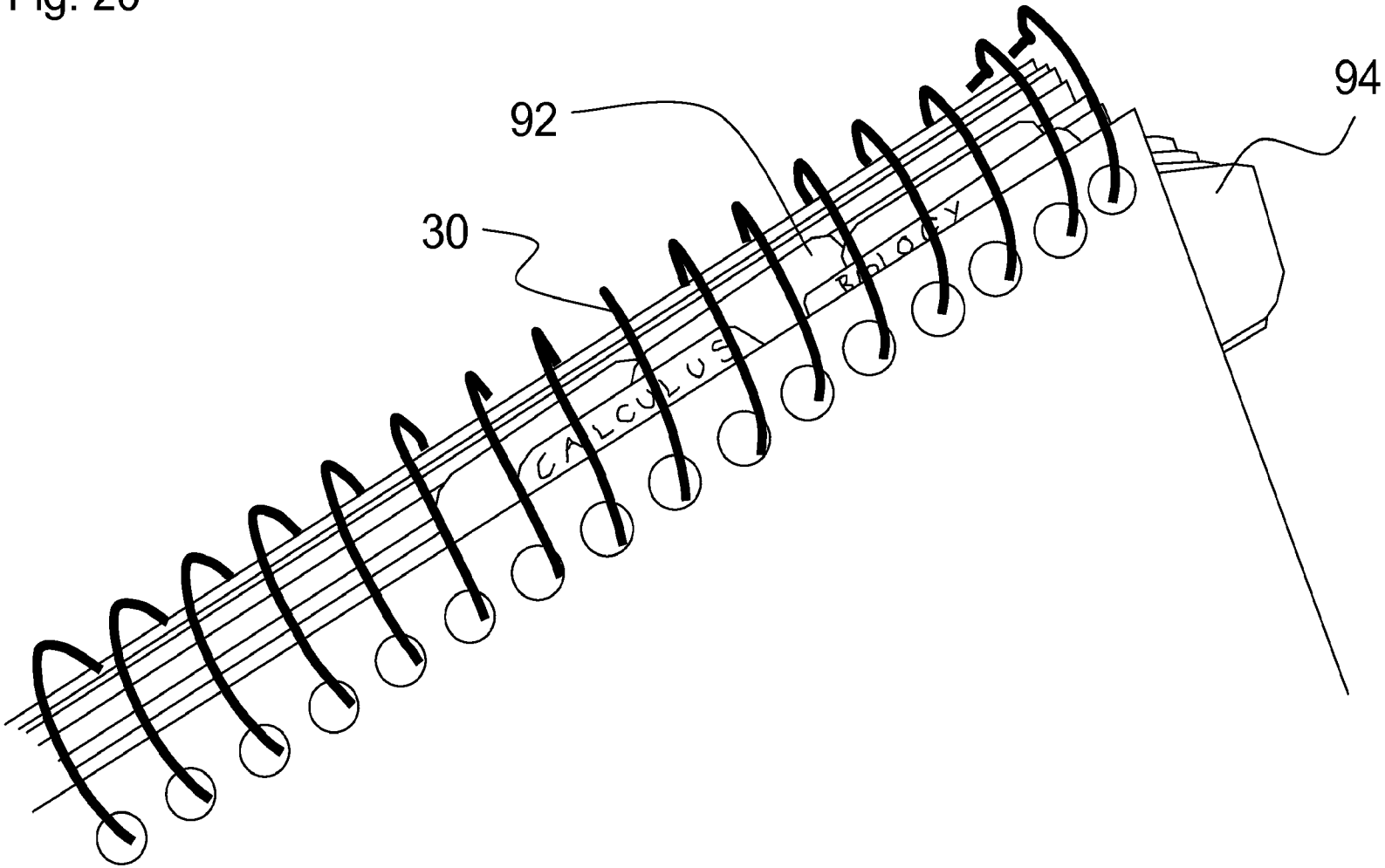
FIG. 20 is an edge perspective view of a notebook using the removable tabs of FIGS. 19A-19C.

FIG. 20 is an edge perspective view of notebooks using the removable tabs of FIGS. 19A-19C. The spine portions 92 with associated information 93 are visible through binding 30 which protects the tabs. The flag portions 94 are accessible for manipulating the notebooks open to particular sections.

Figure 21:
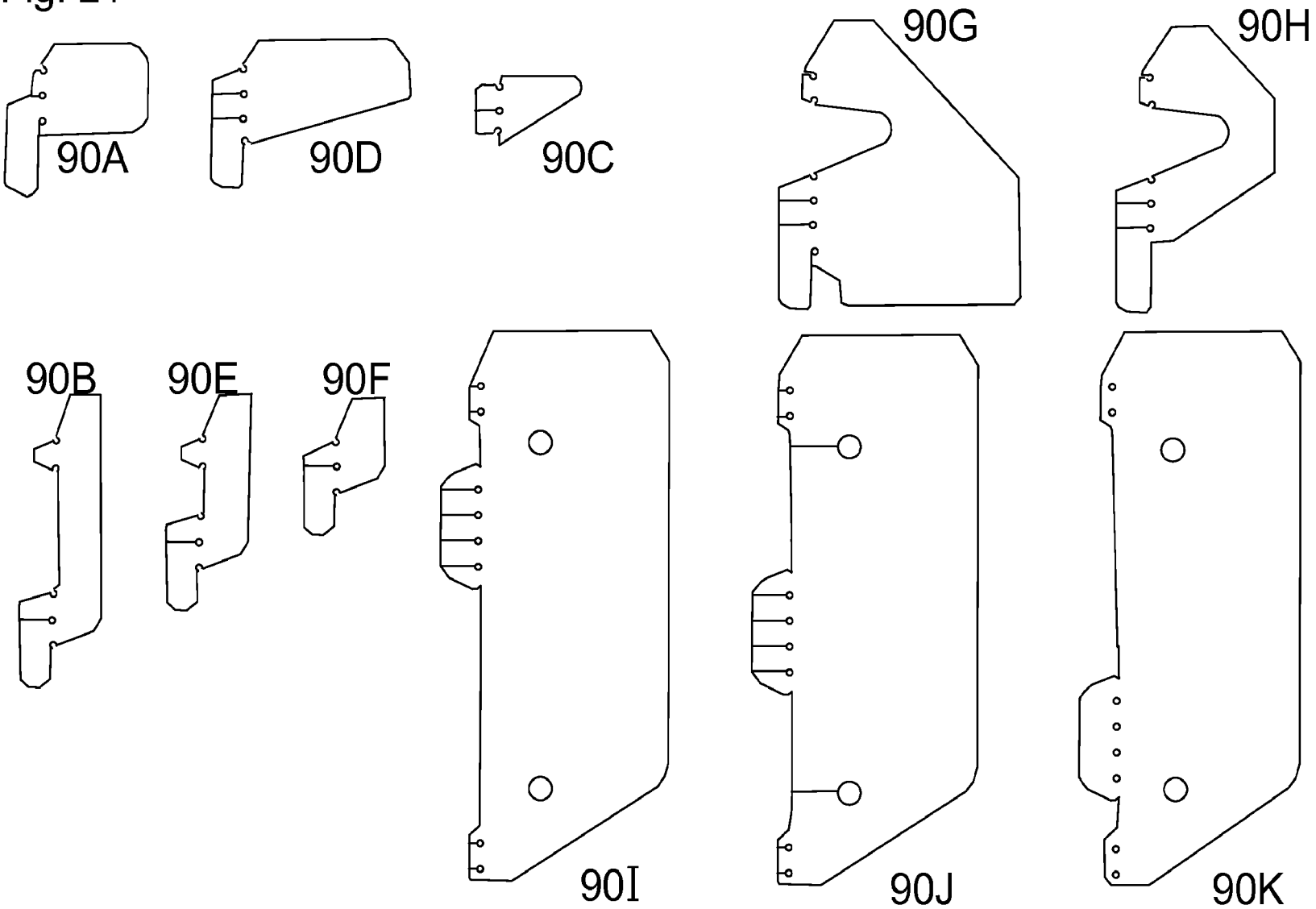
FIG. 21 shows plan views of a variety of exemplary tabs.

FIG. 21 shows top views of a variety of exemplary tabs 90A-90K for example as follows. Tabs 90A, 90B, and 90C were previously described in FIGS. 19A-19C, along with certain features such as spine portion 92, flag portion 94, apertures 95 and slits 96. These features recur in tabs 90D through 90K and need not be repeatedly described here.

The spine portion of tab 90A slides into the binding, then two or more spiral rings snap into apertures in the tab to stabilize the tab. Tab 90D is similar but has a larger area. Small tab 90C allows quick insertion into a spiral ring binding.

Tabs 90B, 90E, and 90F are relatively narrow and extend for different lengths along the binding. Each has a prominent flag portion at the upper end. Since the spine portion and flag portion may be spaced apart from one another, a property such as color or pattern may be used on the divider to help associate the spine and flag portions to one another.

Tabs 90G and 90H may incorporate a cutaway relief throat that helps prevent stresses on the flag portion (for example in opening to the divider) from pulling the apertures and/or slits off the binding. The relief cutaway also provides clearance for a binding ring, for example when the notebook is kept in a ring binder.

Tabs 90I, 90J, and 90K provide for a three-point attachment into a spiral binding, for example across a portion of the spiral binding where the portion of the binding may be the full length of the binding, or less than the full length of the binding Certain elements of the tabs may be modified as desired. For example, tab 90I is shown with closed holes for attachment into a ring binder. Thus the rings of the ring binder must be opened in order to install tab 90I. However, tab 90J is provided with open (slitted) holes for attachment into a ring binder without opening the rings of the ring binder. The binder hole slits in tab 90J allow the tab to be removed from the notebook when the notebook is being stored in a ring binder. Another alternative is shown with tab 90K, where all the holes are closed (whether for spiral wire or ring binding). A tab like 90K could be installed into a notebook by the manufacturer, and then not moveable by the user.

In most of the tab examples shown in FIG. 21, the spine portion of the tab, enclosed within the "binding area" and not occupying space outside the overall size of the notebook, may provide somewhat more information about the divider (e.g. longer descriptions such as "Math", "Art", "Science"), while the flag area which may extend outside the overall size of the notebook may be smaller and provide less information about the divider (e.g. shorter descriptions such as "M", "A", and "5").

Figure 22:
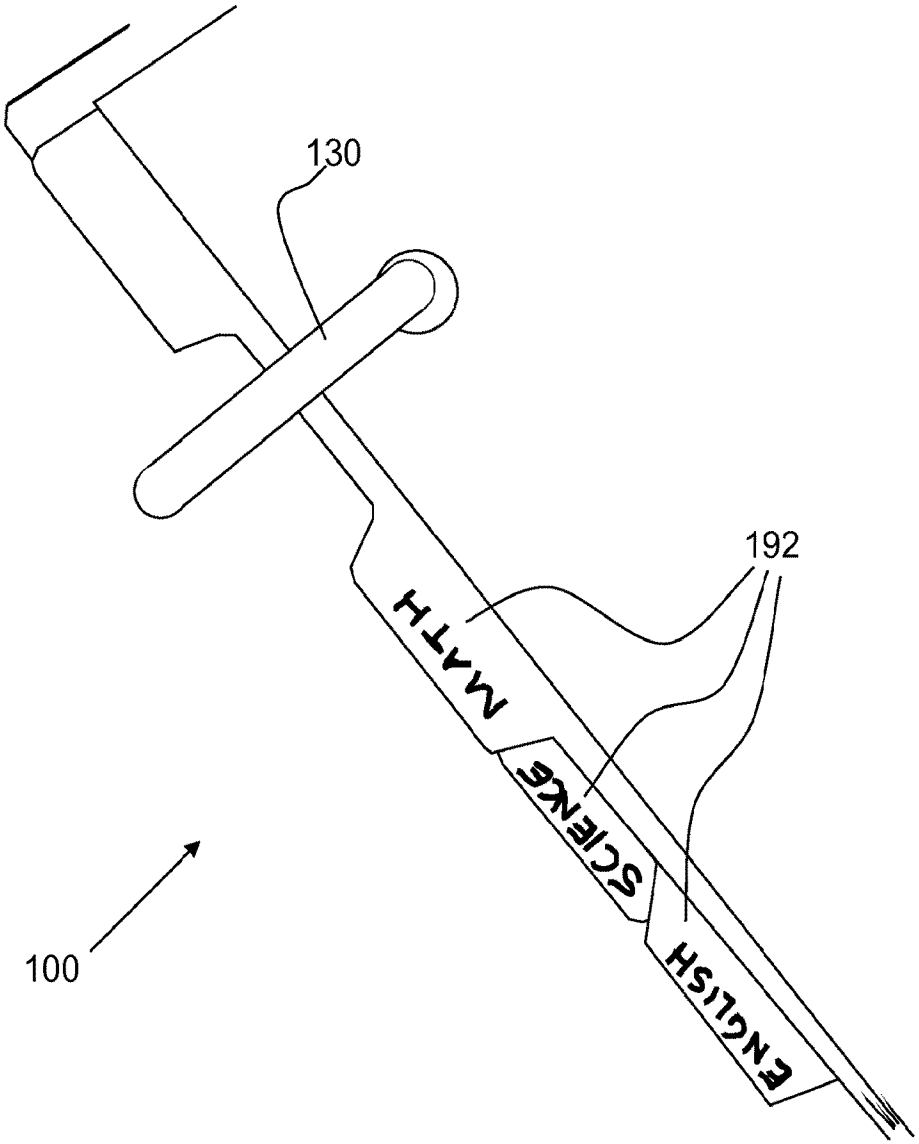
FIG. 22 is a front perspective view of a notebook with ring or other binding, with tabs occupying an area along a bound edge.

FIG. 22 is a front perspective view of a different style of notebook 100 with tab spine portions 192 occupying an area along a bound edge. Notebook 100 may include a binding 130 of flexible rings such as in the FIVE STAR FLEX® Notebinder, notebook, or binder made by MeadWestvaco Corporation. A binding of non-flexible rings may also be used. The tabs as indicated by spine portions 192 may be provided on a bound edge of divider or sheets within the notebook. The spine portions 192 are visible through the binding 130, but are protected by the binding. The spine portions 192 are accessible so that a user may slide a finger under or over the appropriate tab to page to a particular section or sheet within the notebook. A binding sleeve (not shown, but similar to that described for FIG. 1) may cover a portion of the bound edge; however, for visibility and accessibility of the spine portions 192, at least a portion of the bound edge is preferably not covered by a binding sleeve, or the binding sleeve is transparent. In some instances a binding sleeve may exists inside the ring or rings, for example as on a FIVE STAR FLEX® Notebinder, notebook, or binder made by MeadWestvaco Corporation.

Figure 23:
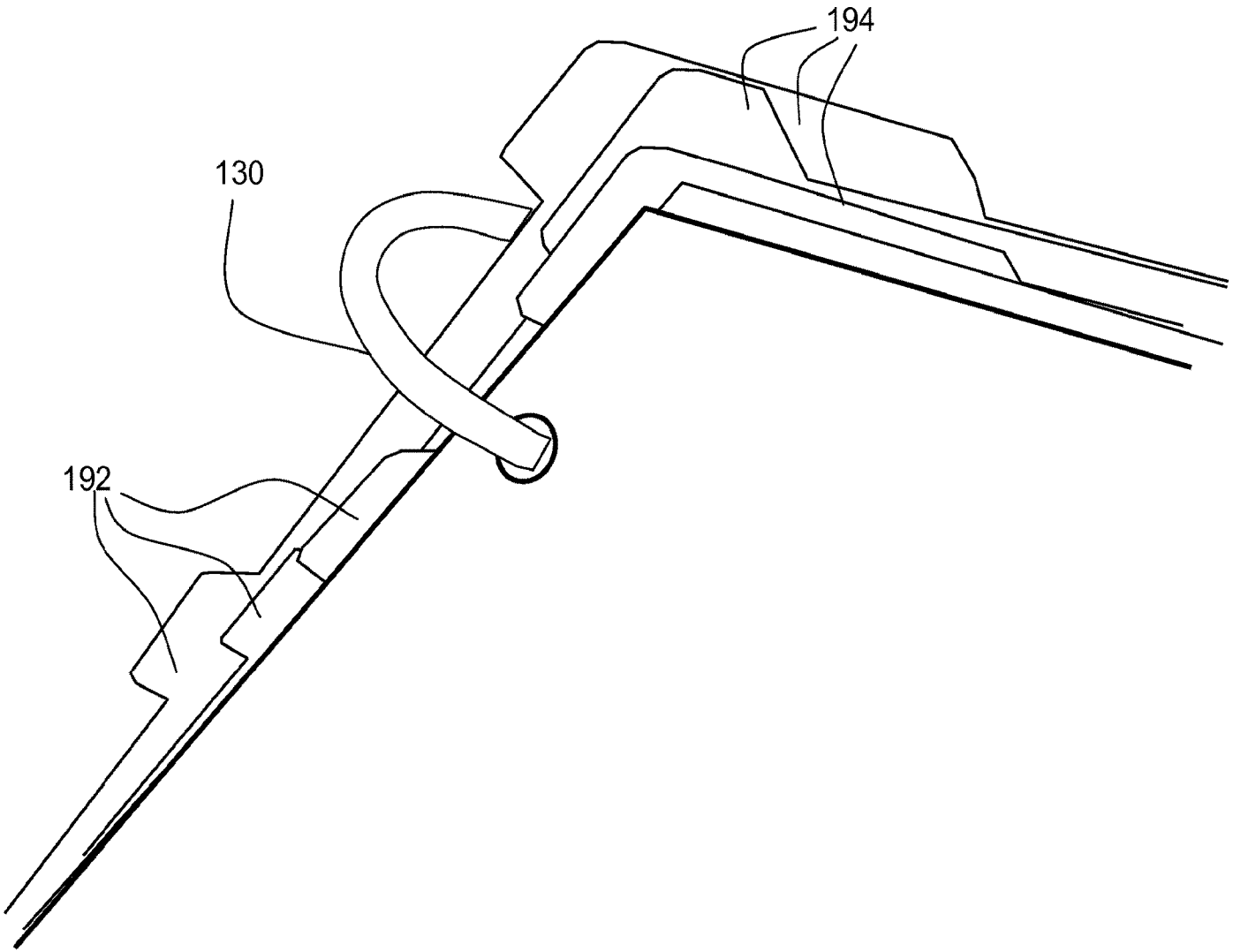
FIG. 23 is a detail view of the tabs of FIG. 22 along a bound edge of the ring-bound notebook.

FIG. 23 is another view of the tabs showing spine portions 192 along a bound edge of a notebook, at an upper corner of the notebook. Besides the spine portion 192 of each tab being visible within the binding 130 of flexible rings, a flag portion 194 may be provided that may extend slightly beyond the upper edge of the notebook. In some cases, at the upper corner of the bound edge, there may be a portion of a tab that extends along the spine and also beyond the upper edge. Of course the flag portion of a tab may be located at either the top or bottom of the bound edge.

Figure 24:
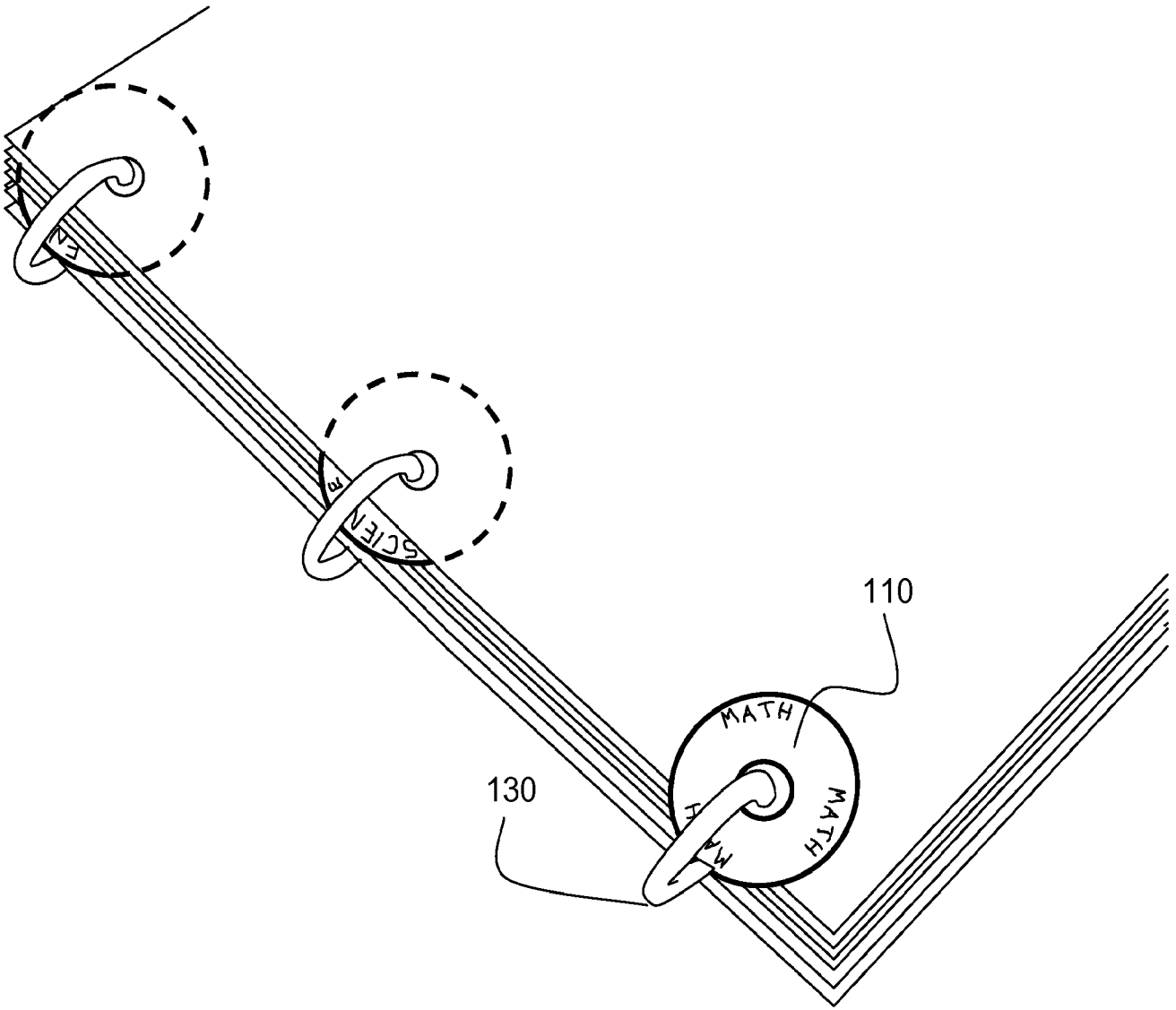
FIG. 24 is a front perspective view of a notebook similar to FIG. 22 using a circular style of tabs along the bound edge.

FIG. 24 is a front perspective view of a notebook using a different style of tabs along the bound edges. The notebook may use circular tabs 110 as shown which include a hole through which binding 130 may be inserted.

Figure 25A:
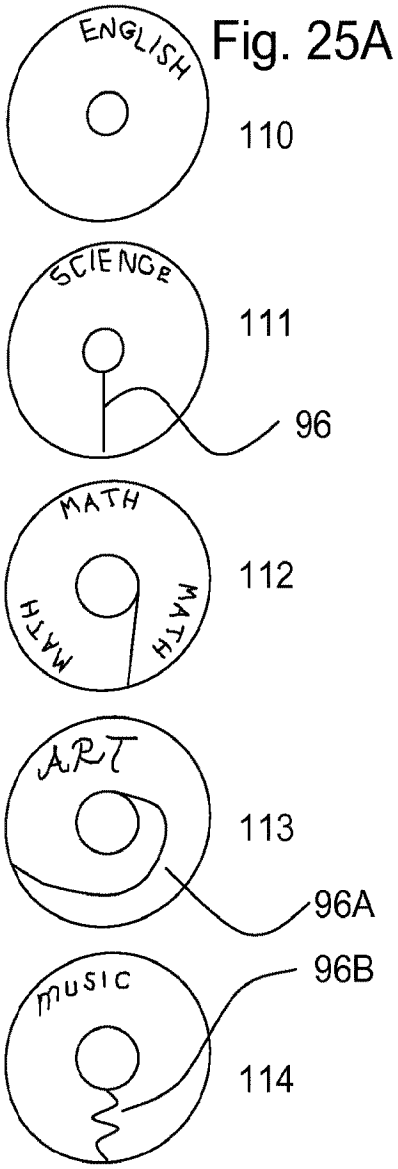
FIGS. 25A-25C show a variety of circular and other tabs.

FIG. 25A shows variations on the circular tabs. Many variations are possible and only a few are shown here. Besides circular tab 110 that has a closed center hole, a circular tab 111 may be provided that has a radial slit 96 to the center hole so that the tab may be placed onto or removed from a ring without opening the ring. Tab 112 is shown with a non-radial slit, for example approximately tangent to an edge of the center hole. Tab 113 may have a spiral slit 96A, and tab 114 may have a meandering slit 96B.

Figure 25B:
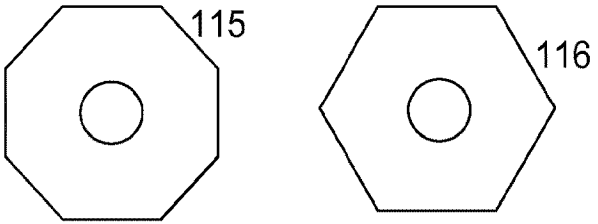

FIG. 25B shows other shapes of tabs such as octagonal tab 115 and hexagonal tab 116.

Figure 25C:
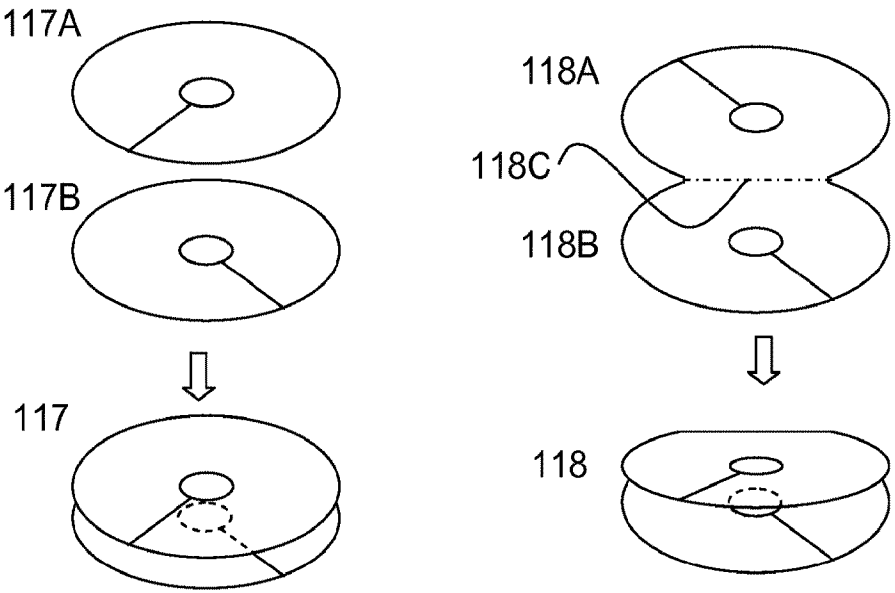

FIG. 25C illustrates the use of two-ply tabs. For example two discs 117A and 117B, similar to tab 111, may be partially glued together or otherwise connected, with offset slits to the center hole to form tab 117 which allows the tab to be placed on a ring, while providing somewhat more strength in holding the tab on the ring. Alternately, a pair of joined discs 118A and 118B may be connected by a hinge line 118C, to form two-ply circular tab 118 with offset slits to the center hole.

It can be seen from the above description that the bound edge tab may provide a divider function that can be positioned within the existing size of a bound notebook, and also without affecting the general size of any tear-out sheet. Variations on the tab design may extend outside of the notebook boundaries for better visibility or access. If the tabs were to be positioned along an unbound edge of the notebook, for example along the top edge, bottom edge, or the edge opposite the bound edge, then tabs that are situated within the existing size of the notebook and did not extend beyond the edge of the tear-out sheets, would require a cutaway in the sheets through which the tabs would be visible. However with the tabs along the bound edge, any cutaway region of the sheet can be made along the bound edge of the sheet, outside of the tear-out dimension.

The bound edge tabs may be provided at or near one or both ends of the bound edge of a notebook, and within the existing boundaries of the product. Variations may extend outside of the notebook boundaries for better visibility and more easy access to the tabs. Divider tabs located at the corner along the bound edge of the notebook may occupy space normally occupied by the binding system. This provides for the user the desirable functionality of tabbing (for location, identification, and/or turning to a particular section) but within the size and confines of the content sheet size.

The bound edge tabs may be provided with portions extending within the volume of the product generally enclosed by the binding, for example, the approximately cylindrical volume defined by the spiral or other binding, including an extended portion of that volume which may project beyond the ends of the binding, or through an interrupted part of the binding. Such a "cylindrical" volume is meant to include "cylinder" shapes with perimeters that are circular, oval, rectangular, square, and other shapes.

The bound edge tabs of the above embodiments can be used in nearly all binders, notebooks, portfolios, planners, date books, and the like. The bound edge tabs provide an assembly that can be quickly and easily manufactured, yet provide an easy and convenient indexing function due to their unique location. The tabs may be used at corners of the bound assembly or at intermediate points along its bound edge. The binding may include spiral wire, twin wire, a ring or rings, and other suitable bindings that bind pages together.

Having described the invention in detail and by reference to the various embodiments, it should be understood that modifications and variations thereof are possible without departing from the scope of the claims of the present application.

What is claimed is:

1. A dividing apparatus comprising:

a removable tab being removable from a wire binding, the removable tab including:

a body portion;

an attachment portion extending from a first side of the body portion and including plurality of notches to facilitate attachment of the removable tab with the wire binding;

a flag portion extending from a second side of the body portion; and a spine tab portion disposed adjacent the attachment portion, wherein the spine tab portion is configured to display information within a cylindrical space defined by the wire binding to which the dividing apparatus is configured to attach.

2. The dividing apparatus of claim 1 wherein the spine tab portion is sized to permit a user to handwrite on a surface of the spine tab portion.

3. The dividing apparatus of claim 1 wherein the first side and the second side of the body portion are orthogonal to one another.

4. The dividing apparatus of claim 1 wherein the spine tab portion of the dividing apparatus has a similar appearance to the flag portion, thereby indicating that the flag portion and the spine tab are associated with one another.

5. The dividing apparatus of claim 1 comprising a plurality of removable tabs including at least a first removable tab and a second removable tab.

6. The dividing apparatus of claim 5 wherein the first removable tab includes a first flag portion and the second removable tab includes a second flag portion, wherein the first and second flag portions are disposed an unequal distance from the wire binding when attached to the wire binding.

7. The dividing apparatus of claim 5 wherein the first removable tab includes a first flag portion and the second removable tab includes a second flag portion, wherein the first and second flag portions have different lengths extending along a top edge of a bound component when attached to the bound component.

8. The dividing apparatus of claim 5 wherein the first removable tab includes a first spine tab and the second removable tab includes a second spine tab, wherein a length of the first spine tab is unequal to a length of the second spine tab.

9. The dividing apparatus of claim 5 wherein the first removable tab includes a first spine tab and the second removable tab includes a second spine tab, wherein the first spine tab and the second spine tab are disposed at different lengths along a spine of the wire binding when secured to the spine.

10. The dividing apparatus of claim 1 wherein the second side of the body portion has a non-linear edge.

11. A bound assembly having the dividing apparatus of claim 1 incorporated therein.

12. A set of divider tabs comprising:

a first removable divider tab being removable from a wire binding, the first removable divider tab having:

a first body portion;

a first attachment portion extending from a first side of the first body portion to facilitate the first removable divider tab being securely attached to the wire binding;

a first flag portion extending from a second side of the first body portion; and a first spine tab disposed adjacent the attachment portion, wherein the spine tab portion is configured to display information within a cylindrical space defined by the wire binding to which the first removable divider tab is configured to attach; and a second removable divider tab being removable from the wire binding, the second removable divider tab having:

a second body portion;

a second attachment portion extending from a first side of the second body portion to facilitate the second removable divider tab being securely attached to the wire binding;

a second flag portion extending from a second side of the second body portion; and a second spine tab disposed adjacent the second attachment portion, wherein the second spine tab portion is configured to display information within the cylindrical space defined by the wire binding to which the second removable divider tab is attached; and wherein the first spine portion and the second spine portion are disposed along different lengths of the cylindrical space defined by the wire binding.

13. A bound assembly having the set of divider tabs of claim 12 incorporated therein.

14. The bound assembly of claim 13 wherein the first flag portion and the second flag portion are disposed along different lengths of an upper edge of the bound assembly when attached the bound assembly.

15. A set of divider tabs comprising:

a first removable divider tab being removable from a wire binding, the first removable divider tab having:

a first body portion;

a first attachment portion extending from a first side of the first body portion to facilitate the first removable divider tab being securely attached to the wire binding; and a first flag portion extending from a second side of the first body portion;

a second removable divider tab being removable from the wire binding, the second removable divider tab having:

a second body portion;

a second attachment portion extending from a first side of the second body portion to facilitate the second removable divider tab being securely attached to the wire binding; and a second flag portion extending from a second side of the second body portion;

and wherein the first and second flag portions are disposed an unequal distance from the wire binding when attached to the wire binding.

16. The set of divider tabs of claim 15 wherein the first removable divider tab further comprises a first spine tab portion and the second removable divider tab further comprises a second spine tab portion.

17. The set of divider tabs of claim 16 wherein the first spine portion and the second spine portion are disposed along different lengths of the cylindrical space defined by the wire binding.

18. The set of divider tabs of claim 16 wherein the first side of the first and second removable divider tabs and the second side of the first and second removable divider tabs are orthogonal to one another.

19. A bound assembly having the set of divider tabs of claim 15 incorporated therein.

* * * * *